US009511381B2

(12) United States Patent
Takahashi

(10) Patent No.: US 9,511,381 B2
(45) Date of Patent: Dec. 6, 2016

(54) SPRAY NOZZLE AND AEROSOL PRODUCT

(75) Inventor: Tomoyuki Takahashi, Ibaraki (JP)

(73) Assignee: DAIZO CORPORATION, Osaka (JP)

( * ) Notice: Subject to any disclaimer, the term of this patent is extended or adjusted under 35 U.S.C. 154(b) by 741 days.

(21) Appl. No.: 13/512,293

(22) PCT Filed: Nov. 25, 2010

(86) PCT No.: PCT/JP2010/071001

§ 371 (c)(1),
(2), (4) Date: Jun. 6, 2012

(87) PCT Pub. No.: WO2011/065413

PCT Pub. Date: Jun. 3, 2011

(65) Prior Publication Data

US 2012/0234947 A1 Sep. 20, 2012

(30) Foreign Application Priority Data

Nov. 25, 2009 (JP) ..... 2009-268164
Jan. 29, 2010 (JP) ..... 2010-019726
Jul. 27, 2010 (JP) ..... 2010-168378

(51) Int. Cl.
*B05B 1/02* (2006.01)
*B65D 83/28* (2006.01)
(Continued)

(52) U.S. Cl.
CPC . *B05B 1/02* (2013.01); *B05B 1/04* (2013.01); *B05B 1/042* (2013.01); *B05B 1/048* (2013.01);
(Continued)

(58) Field of Classification Search
CPC ..... B05B 1/3431; B05B 1/00; B05B 1/02; A62C 31/02
USPC ..... 239/490, 396, 392, 493, 491, 484, 589, 239/601; 222/575, 566
See application file for complete search history.

(56) References Cited

U.S. PATENT DOCUMENTS 3,568,933 A * 3/1971 Macguire-Cooper ..... 239/543
3,606,169 A * 9/1971 West ..... A62C 31/005 239/568

(Continued)

FOREIGN PATENT DOCUMENTS

DE 24 40 909 A1 4/1975
EP 0 884 016 A1 12/1998

(Continued)

OTHER PUBLICATIONS

Supplementary European Search Report for the Application No. EP 10 3259 dated Aug. 9, 2013.

(Continued)

*Primary Examiner* — Arthur O Hall
*Assistant Examiner* — Christopher R Dandridge
(74) *Attorney, Agent, or Firm* — Cheng Law Group, PLLC

(57) ABSTRACT

[Problem to be solved] To provide a spray nozzle and an aerosol product in which the density difference between the center and the periphery is small. And to provide a spray nozzle and an aerosol product which give a spray pattern in which the spray density of peripheral portion does not decrease so much.
[Solution]
A nozzle 10 for an aerosol product, in which the shape along the spray direction of the spray pattern F becomes a semi parabolic shape. The nozzle 10 in which the spray pattern is planar or plate-like surrounded by a semi parabola-like shape and a center line C, and in which the planar spray thereof becomes a shape such that a plurality of sheets is arranged at an equal interval in a circumferential direction around the center C of the nozzle.
The cross section of the spray pattern F can be formed into various shapes of an I type, a Y type, an X type, a V type, an S type etc according to the shape of slit passage of the front face of the nozzle 10. An aerosol product E equipped with a container body 31, a valve 32 provided in the upper end of the container body, and a nozzle 10 attached to the valve thereof.

18 Claims, 34 Drawing Sheets

(51) Int. Cl.

| | |
|---|---|
| ***B05B 1/04*** | (2006.01) |
| ***B05B 1/06*** | (2006.01) |
| ***B05B 1/34*** | (2006.01) |
| ***B65D 83/20*** | (2006.01) |
| *B05B 1/14* | (2006.01) |
| *B05B 1/26* | (2006.01) |

(52) U.S. Cl.

CPC ..... *B05B 1/06* (2013.01); *B05B 1/3405* (2013.01); *B65D 83/206* (2013.01); *B65D 83/28* (2013.01); *B05B 1/14* (2013.01); *B05B 1/262* (2013.01)

(56) References Cited

U.S. PATENT DOCUMENTS

| | | | | |
|---|---|---|---|---|
| 3,652,018 | A * | 3/1972 | Focht | B05B 1/3431 239/490 |
| 4,222,525 | A * | 9/1980 | Hildebrandt | 239/343 |
| 4,706,888 | A * | 11/1987 | Dobbs | B05B 1/12 239/478 |
| 5,114,052 | A * | 5/1992 | Tiramani | B05B 11/0016 222/207 |
| 5,178,325 | A * | 1/1993 | Nielsen | 239/1 |
| 6,199,766 | B1 * | 3/2001 | Fox et al. | 239/3 |
| 6,783,085 | B2 * | 8/2004 | Xu | F02M 61/162 239/463 |
| 2007/0176028 | A1 * | 8/2007 | Laidler et al. | 239/589 |
| 2009/0266923 | A1 | 10/2009 | Gardner et al. | |

FOREIGN PATENT DOCUMENTS

| | | | |
|---|---|---|---|
| EP | 1 738 831 | A1 | 1/2007 |
| JP | 42-9484 | | 5/1967 |
| JP | 53-26414 | | 7/1978 |
| JP | 61-54248 | A | 3/1986 |
| JP | 61-16162 | | 7/1986 |
| JP | 63-196766 | U | 12/1988 |
| JP | 6-14081 | U | 2/1994 |
| JP | 6-276908 | A | 10/1994 |
| JP | 10-151380 | A | 6/1998 |
| JP | 2000-271511 | A | 10/2000 |
| JP | 2000-325834 | A | 11/2000 |
| JP | 2001-205145 | A | 7/2001 |
| JP | 2002-301403 | A | 10/2002 |
| JP | 2003-226382 | A | 8/2003 |
| JP | 2004-113993 | A | 4/2004 |
| JP | 2006-320775 | A | 11/2006 |
| JP | 2006-320857 | A | 11/2006 |
| JP | 2007-7495 | A | 1/2007 |
| JP | 2008-162642 | A | 7/2008 |
| JP | 2009-178215 | A | 8/2009 |
| WO | WO-97/30619 | A1 | 8/1997 |

OTHER PUBLICATIONS

International Search Report for the Application No. PCT/JP2010/071001 mailed Mar. 8, 2011.

Supplementary European Search Report for the Application No. EP 10 83 3259 dated Aug. 9, 2013.

* cited by examiner (a)

(b)

(a)

(b)

(a)

(b)

(a)

(b)

(a)

(b)

(a)

(b)

(c)

(a)

(b)

(a)

(b)

SPRAY NOZZLE AND AEROSOL PRODUCT

FIELD OF THE INVENTION

The present invention relates to a spray nozzle and an aerosol product.

DESCRIPTION OF BACKGROUND ART

In a commonly used aerosol product, a spray pattern becomes an approximate conical shape, when a content passing through the passage in a spray button is sprayed directly from a spray nozzle, (spraying by a straight button, not having a mechanical break-up mechanism). For example, if spraying is performed to a paper placed at a predetermined distance from a spray nozzle, the sprayed content adheres to the paper in the shape of an approximate circle. And, the diameter of the circle becomes large in proportion to the distance from the nozzle hole. On the other hand, in the case of spraying an insecticide to a net window, and in the case used for a paint spraying, there may be a case that the pattern other than a circle is desired for spraying. On the other hand, in the case of spraying an insecticide to a net window, and in the case used for a paint spraying, there may be a case that the pattern other than a circle is desired for spraying. Heretofore, nozzles of various modified spray patterns used for such cases have been proposed.

For example, Patent Document 1 is that in which a pair of column-like protrusions is provided in the both sides of a nozzle hole, the expansion of a sprayed content toward right and left is regulated by these protrusions, and it is possible to obtain a vertically long spray pattern. Patent Document 2 discloses a nozzle in which a pair of pentroof planes opposedly facing in parallel spaced nearly identical with the diameter of the opening or less than two times of the diameter is formed in front of the opening of the nozzle hole. This can obtain a spray pattern of a thin and broad spreading angle by spraying through a narrow gap of the pair of pentroof planes. Also, Patent Document 3 teaches a nozzle equipped with a pair of pentroof-like protrusions above and below or right and left of a nozzle hole same as Patent Document 2.

Patent Document 4 discloses a flat spray type gas-liquid mixing spray nozzle used for cooling a red hot steel plate and for spraying a medical agent to crops in vegetable gardens. This gas-liquid mixing spray nozzle is equipped with a bottomed cylinder-like nozzle body having an inner bottom plane of taper shaped (approximately spherical), and a slit-like orifice is cut in along the nozzle center axis from outside to connect inside and outside. The insection reaches the vicinity of the position where the tapered inner bottom plane starts, and expands at an angle of 180 degrees. In such nozzles generally, the amount of spray becomes large in three places of the center and the both sides. In Patent Document 4, uniformizing of the amount of spray is attained by forming an approximately spherical inner bottom plane in a two-stage stacked state.

The nozzle of Patent Document 5 is a nozzle of an aerosol device nearly same as the nozzle of Patent Document 4, but the depth of insection of the slit is made rather shallow. Thereby, in the opening by the insection, the angle (contact angle) to the center of the semispherical or semicolumn-like inner bottom plane (the front end of outflow) becomes about 90 degrees. With that, it is described that the expansion of the spray angle can be set within a desired range.

Patent Document 6 proposes to attain the uniformizing of the amount of spray by forming the external surface shape of front end of a spray nozzle into a spherical surface etc. and by reducing the depth of the slit toward a side end portion from a center portion. Patent Document 7 discloses a spray nozzle which can perform spraying softly, by arranging three spray holes vertically, and can obtain a vertically long spray pattern.

PRIOR ART DOCUMENTS

Patent Documents

Patent Document 1: Japanese published Patent Document 2004-113993
Patent Document 2: Japanese Utility Model Patent Document S42-9484
Patent Document 3: Japanese published Patent Document 2009-178215
Patent Document 4: Japanese published Patent Document S61-161162
Patent Document 5: Japanese published Patent Document 2001-205145
Patent Document 6: Japanese published Patent Document 2006-320775
Patent Document 7: Japanese published Patent Document 2006-320857

DISCLOSURE OF THE INVENTION

Problems to be Solved

In a spray by a straight button, the density of a spray pattern is high in the vicinity of the center line of a nozzle hole and the density becomes low as it nears the periphery, and a density gradient is generated. The main cause of this is that a content passes through a passage in a spray button, and is sprayed from the spray hole in a direction same as the passage, where the flow of liquid and the stream of air becomes more as it nears the center portion of spray. And, in the peripheral portion, particularly in the contour portion, since the density is thin, the stream of spray receives the resistance of surrounding air, and the sprayed content deviates from the spray direction and wafts, where the wafting sprayed particle losses its directivity. Since the speed of the sprayed particles is slow, when performing a flame length test, the wafting sprayed particles are ignited, a backfiring phenomenon in which flame counter-flows to a nozzle hole side tends to be generated. Moreover, in a spray nozzle giving the publicly known modified spray pattern, even if the direction of the spray is forcibly deflected by such as surrounding the nozzle hole, since the amount of spray is small in a peripheral portion, and the density of the sprayed particles is low, the spray pattern becomes a triangular shape in cross section in side view, inevitably leading to wafting and scattering.

The present invention is directed to provide a spray nozzle and an aerosol product, which can obtain a spray pattern of which the density difference between the center and the periphery is small, and there is no wafting and scattering in the contour portion. Further, the present invention is directed to provide a spray nozzle and an aerosol product which gives a modified spray pattern of which the density of the sprayed particles in the peripheral portion does not decrease so much.

Means of Solving the Problem

The first embodiment of the spray nozzle of the present invention is characterized in that the contour portion of the spray pattern is pulled inside by spraying, a shape along the spray direction of the spray pattern being formed into an approximate semi parabolic shape. In such a spray nozzle, the spray pattern is preferable to be planar or plate-like surrounded by the approximate semi parabola and a nozzle hole center line.

Any of spray nozzle above described is preferable to be equipped with a spray pattern composed of more than two line segments expanding outwardly from the nozzle hole center line when viewed from the front. In this case, the line segments are preferable to be arranged in rotation symmetry centered at the spray hole center. Moreover, it may be that in which the line segment is an approximate circular arc shape. Further, it may be that in which the line segments are straight lines or curved lines arranged in a V-character shape. Furthermore, it may be that in which the line segments are straight lines or curved lines arranged in a Y-character shape.

Furthermore, it may be that in which the center of the nozzle hole center is decentered from the center of the nozzle, and the line segments of the spray pattern extend toward the approximate opposite side of the nozzle from the nozzle hole center. Further, it may be that in which two or more of nozzle holes are equipped, and the spray pattern is composed of line segments of straight lines or curved lines passing through the front end opening of each nozzle hole.

Moreover, it is preferable that a spray nozzle has, inside thereof, a passage to make a content pass through, a convergent taper portion or a gradient portion provided in a front end of the passage, and a small diameter nozzle hole passage extending from the front end of the taper portion or the gradient portion, in which a slit passage which connects a nozzle hole which is the opening end of the nozzle hole passage and an outer space is provided. The second embodiment of the spray nozzle of the present invention is characterized in that a spray nozzle has, inside thereof, a passage to make a content pass through, a convergent taper portion or a gradient portion provided in a front end of the passage, and a small diameter nozzle hole passage extending from the front end of the taper portion or the gradient portion, in which a slit passage which connects a nozzle hole which is the opening end of the nozzle hole passage with an outer space is provided. In this case, it is further preferable that an opening which is connected with outside is formed outwardly in a radial direction from the vicinity of the front end of the nozzle hole.

On the other hand, a spray nozzle can also be made so that it has, inside thereof, a passage to make a content pass through, a convergent taper portion or a gradient portion provided in the front end of the passage, wherein a slit passage which connects a nozzle hole in which a part of the taper portion or the gradient portion is made to open, and an outer space is provided. The third embodiment of the spray nozzle of the present invention is characterized in that it has, inside thereof, a passage to make a content pass through, a convergent taper portion or a gradient portion provided in the front end of the passage, in which a slit passage which connects a nozzle hole in which a part of the taper portion or the gradient portion is made to open, and an outer space is provided. Further, it may be that in which a part of the front end of the nozzle hole is plugged. Furthermore, it may be that in which the spray pattern is of parallel two planes when immediately after spraying, and then both sides are integrated into one plane by coming close. Moreover, it is preferable that a spray nozzle has an inner nozzle equipped with a passage to make a content pass through and a convergent taper portion provided in the front end of the passage, and an outer nozzle covered on the inner nozzle, being equipped with a slit passage connecting inside and outside thereof, in which between the inner nozzle and the outer nozzle, a spray passage connecting the taper portion and the slit passage is preferable to be formed.

The forth embodiment of the spray nozzle of the present invention is characterized in that a spray nozzle has an inner nozzle equipped with a passage to make a content pass through and a convergent taper portion provided in the front end of the passage, and an outer nozzle covered on the inner nozzle, being equipped with a slit passage connecting inside and outside thereof, in which between the inner nozzle and the outer nozzle, a spray passage connecting the taper portion and the slit passage is formed. In such a spray nozzle, it is preferable that the inner nozzle is equipped with a squeezing passage extending from the front end of the taper portion, between the inner nozzle and the outer nozzle, a spray passage which connects the squeezing passage and the slit passage is formed. Further, it is preferable that the outer nozzle is provided so as to be freely detachable and attachable in the outer periphery of the inner nozzle. Moreover, it is further preferable that a spray nozzle has a nozzle body equipped with a passage to make a content pass through, a convergent taper portion provided in the front end of the passage, a squeezing passage extending from the front end of the taper portion, an empty space connected with the squeezing passage, and a slit passage connecting the empty space and outside, and an outer nozzle housed in the empty space, in which between the outer nozzle and the inner surface of the empty space, a spray passage which connects the squeezing passage and the slit passage is formed.

The fifth embodiment of the spray nozzle of the present invention is characterized in that a spray nozzle has a nozzle body equipped with a passage to make a content pass through, a convergent taper portion provided in the front end of the passage, a squeezing passage extending from the front end of the taper portion, an empty space connected with the squeezing passage, and a slit passage connecting the empty space and outside, and an outer nozzle housed in the empty space, in which between the outer nozzle and the inner surface of the empty space, a spray passage which connects the squeezing passage and the slit passage is formed. In such a spray nozzle, it is preferable that the outer nozzle is provided so as to be freely detachable and attachable to the nozzle body.

The aerosol product of the present invention is characterized in that it is equipped with a container body, a valve provided on the upper end of the container body, and a spray nozzle attached to the valve. It is preferable that the valve is a constant amount spray valve.

In the first embodiment of the spray nozzle of the present invention, the contour portion of the spray pattern is pulled inside by spraying, the shape along the spray direction of the spray which is drawn by the sprayed particles, stated differently, the outside trajectory of the sprayed particles sprayed by pressurization such as a pressure inside of an aerosol container and a manual pump becomes an approximate semi parabolic shape. Accordingly, the sprayed particles of outside do not expand straightly, resulting in to return inside to a certain extent while expanding, Hence, the spray density of a peripheral portion which tends usually to be thin becomes thick, a spray pattern of which the density difference between the center and the peripheral portion is small can be obtained. Further, since it is suppressed that sprayed particles whose density is thin scatter or waft in the contour portion, losing the directivity of spray, even if it is the spray of the flammable content, a backfiring phenomenon (a phenomenon in which the flame returns propagating through the sprayed particles, when spraying toward a flame) is hard to occur. Moreover, since in the spray nozzle of the present invention the expansion of spray pattern is large, a content can be effectively spread, it can be used suitably to a compact spray in which the density of the content is made thick, and the use amount of one time is made small or regulated by a constant amount valve etc.

In such a spray nozzle, when the spray pattern is planar or plate-like surrounded by an approximately semi parabolic shape and a nozzle hole center line, stated differently, not only an outside plane comes close to the center side, but also become a flattened shape, the cross section of the spray pattern in a center line direction is proportional to a distance. Hence, compared with the spray of a conical shape etc. in which the cross section is proportional to square of a distance, the change (increase) of the cross section is small. Accordingly the expansion of the spray is suppressed and the density difference between the center portion and the peripheral portion becomes further small.

In the spray nozzle which is equipped with a spray pattern composed of more than two line segments expanding outwardly from the nozzle hole center line when viewed from the front, the increase of the cross section of the spray along the center line is small, and the expansion of the spray is suppressed. Hence, the density difference between the outside and the center portion does not extend so much.

In the case that the line segments are arranged in rotation symmetry centered at the nozzle hole center, the expansion of the spray pattern becomes symmetry interleaving the center line, the opposite side line segments pull mutually, stabilizing the spray pattern, making it possible to spray accurately to an object spray target (human body, fixed object such as a paned window, a net window, a wall, space etc.). In the case that the line segment is an approximately circular arc shape, the area of the spray pattern becomes large, making it easy to obtain the effect. Further, in the case that the line segments are straight lines or curved lines arranged in a V-character shape, since the spray pattern is pulled in a direction expanding in the V-character shape, the spray zone can be controlled such as not to spray below the V-character shape. Moreover, in the case that the line segments are straight lines or curved lines arranged in a Y-character shape, particularly when the arrangement of the Y-character shape is a curved line, spraying is performed like a tornado shape.

In the case that the nozzle center is decentered from the center of the nozzle, and the line segments of the spray pattern extend toward the approximately opposite side of the nozzle from the nozzle hole center, the spraying can be performed in a modified pattern in which the spray is disproportionated on one side such as a U-character shape. Furthermore, in the case also that two or more of nozzles are equipped, and the spray pattern is composed of line segments of straight lines or curved lines passing through the front end opening of each nozzle hole, a modified pattern which is hard to obtain by the case of one nozzle hole can be obtained.

Moreover, in the case that a spray nozzle has, inside thereof, a passage to make a content pass through, a convergent taper portion or a gradient portion provided in the front end of the passage, and a small diameter nozzle hole passage extending from the front end of the taper portion or the gradient portion, in which a slit passage which connects a nozzle hole which is the opening end of the nozzle hole passage and an outer space is provided, and in the case of the second embodiment of the nozzle of the present invention, air flow which gradually becomes of high speed in the taper portion or the gradient portion spouts outside expanding thinly from the slit passage through the nozzle hole passage. Thereby, a further distinct spray pattern can be obtained. Further, in the case that an opening which is connected with the outside is formed outwardly in a radial direction from the vicinity of the front end of the nozzle hole, the sprayed object is easy to expand outwardly, the spray pattern becomes large, making it possible to spread over a wide range.

Moreover, in the case that a spray nozzle has, inside thereof, a passage to make a content pass through, a convergent taper portion or a gradient portion provided in the front end of the passage, in which a slit passage which connects a nozzle hole in which a part of the taper portion or the gradient portion is made to open, and an outer space is provided, and in the case of the third embodiment of the spray nozzle of the present invention, air flow which gradually becomes of high speed in the taper portion or the gradient portion spouts outside expanding thinly from the slit passage passing through the nozzle hole passage. Thereby, further distinct spray pattern can be obtained. In this case, when a part of the front end of the nozzle hole is plugged, since the spray going ahead passing through the center is interrupted, the expansion to the periphery is further increased, In the case that the spray pattern is of parallel two planes when immediately after spraying, and then they are integrated into one plane by coming close, a larger width spread spray pattern can be obtained, when the other conditions such as a spray pressure are identical.

In the case that a spray nozzle has an inner nozzle equipped with a passage to make a content pass through and a convergent taper portion provided in the front end of the passage, and an outer nozzle covered on the inner nozzle, being equipped with a slit passage connecting inside and outside thereof, in which between the inner nozzle and the outer nozzle, a spray passage connecting the taper portion and the slit passage is formed, or in the case of the forth embodiment of the spray nozzle of the present invention, since the nozzle is constituted by two parts of an inner nozzle and an outer nozzle, the manufacture is easy, and the change of size and shape of the gap of the spray passage is easy. In the case that the inner nozzle is equipped with a squeezing passage extending from the front end of the taper portion, between the inner nozzle and the outer nozzle, a spray passage which connects the squeezing passage and the slit passage is formed, since a content once squeezed in the passage is sprayed outside from the slit passage while expanding in the nozzle passage, a moderate spray pattern can be obtained. Furthermore, in the case that the outer nozzle is provided being freely detachable and attachable in the outer periphery of the inner nozzle, the spray pattern can be changed by only replacing the outer nozzle. Moreover, it has a merit that even if the very thin spray passage is clogged with a foreign matter, it can be easily removed.

In the case that the spray nozzle has a nozzle body equipped with a passage to make a content pass through, a convergent taper portion provided in the front end of the passage, a squeezing passage extending from the front end of the taper portion, an empty space connected with the squeezing passage, and a slit passage connecting the empty space and outside, and an outer nozzle housed in the empty space, in which between the outer nozzle and the inner surface of the empty space, a spray passage which connects the squeezing passage and the slit passage is formed, or in the case of the fifth embodiment of the spray nozzle of the present invention, since the nozzle is constituted by two parts of a nozzle body and an outer nozzle, the manufacture is easy, and the change of size and shape of the gap of the spray passage is easy. Further, in the case that the outer nozzle is provided so as to be freely detachable and attachable to the nozzle body, it has a merit that even if the very thin spray passage is clogged with a foreign matter, it can be easily removed.

Since an aerosol product of the present invention is equipped with any of above described spray nozzle, the aerosol product exerting action and effects by each spray nozzle can be obtained. In the case that the valve is a constant amount spray valve, excess spraying can be prevented. Further, in the case that it is adopted together with the above described nozzle which can spray at a wide angle, since it is sprayed at the wide angle, even if being a small amount of spray, the amount of spray looks like a large amount of spray. Hence, the excess spraying is further prevented.

BEST MODE FOR CARRYING OUT THE INVENTION

An aerosol product E shown in FIG. 1*a* is characterized in that the three dimensional shape of a spray pattern F sprayed from a nozzle (spray nozzle) 10, particularly the shape viewed from the side expresses a parabolic shape. Stated differently, the spray pattern of a conventional aerosol product equipped with a straight spray nozzle is thin immediately after spraying, and expresses an approximately conical shape, because it gradually expands as it departs from the nozzle 10. In other words, since the spray particles scatter approximately straightly, the cross sectional shape of the spray pattern becomes a circle in proportion to the distance from a nozzle, and becomes a conical pattern as the three dimensional shape. However, in the aerosol product E of FIG. 1*a*, FIG. 1*b*, the spray pattern F is not a conical shape, and expands in an approximately parabolic shape. The cross sectional shape of the spray pattern F may be circular, in which case, the peripheral plane becomes an approximate paraboloid of revolution. However, in this embodiment, as shown in FIG. 1*c*, it expresses an approximate Y-character shape composed of three branches extending in three directions from a center portion at an equal interval.

Figure 2:
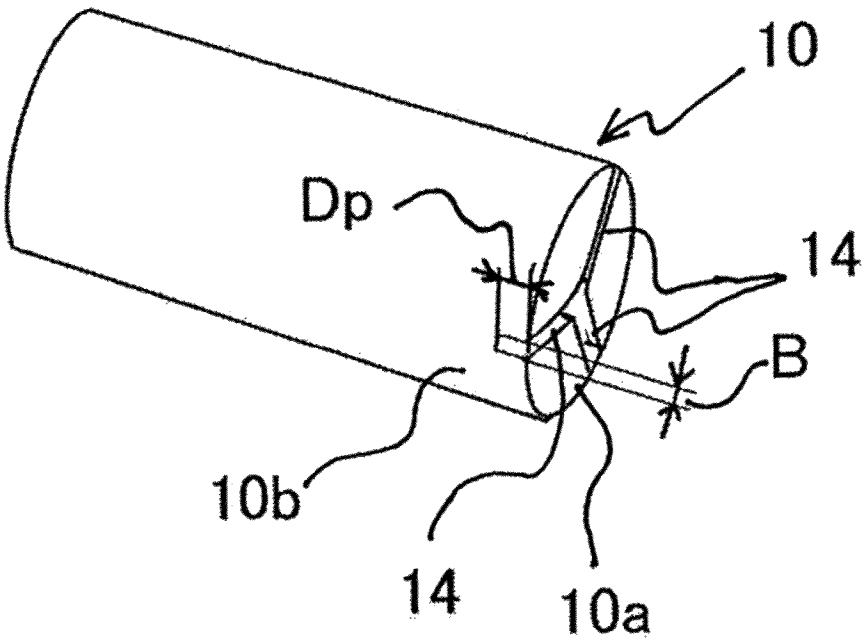
FIG. 2 is an enlarged perspective view of the spray nozzle used in the aerosol product of FIG. 1.

The above described nozzle 10 is attached to a push button 11 through a spacer 12. The appearance of the nozzle 10 is an approximate column shape as shown in FIG. 2, and it is equipped with three slit passages 14 arranged radially at an equal interval in a front end face 10*a*. The slit passage 14 is cut in to the front end face 10*a*, and the outer periphery thereof reaches a side face 10*b* (refer to FIG. 3*a*, 3*b*). As shown in FIG. 3*a* and FIG. 4, in the interior of the nozzle 10, an approximately column like passage 16 to make a content pass through, a convergent taper portion 17 provided in the front end of the passage 16 thereof, a small diameter nozzle hole passage 18 extending from the front end of the taper portion 17, and a slit passage 14 which connects the nozzle hole which is the opening end of the nozzle passage and an outer space are formed. These passage 16, taper portion 17, nozzle hole passage 18, and slit passage 14 are cavities or spaces formed in a physical body constituting the nozzle 10.

The taper portion 17 is of the shape of truncated cone, the nozzle hole passage 18 is column-like in shape. The taper angle α of the taper portion 17 is usually 30-120 degrees, preferably 40-110 degrees. In addition, the taper portion 17 may be made into a circular arc shape in cross section (refer to FIG. 10*e*), a protrusion and a groove may be provided in the inner plane thereof for controlling the flow of a content. When the taper angle α is smaller than 30 degrees, or larger than 120 degrees, the density of the center portion of the spray pattern becomes thick, the contour portion is not pulled inside, causing the cross section of side view of the spray pattern to become a triangle shape, and it becomes hard to obtain the effect of preventing wafting and scattering. Moreover, the length of the taper portion is 0.5-3 times of that of the nozzle hole passage, preferably 0.7-2.8 times. When the length of the taper portion is smaller than 0.5 times, or larger than 3 times also, the density of the center portion of the spray pattern becomes thick, the contour portion is not pulled inside, causing the cross section of side view of the spray pattern to become a triangle shape, and it becomes hard to obtain the effect of preventing wafting and scattering. In this embodiment, the slit passage 14 is a groove extending straight outwardly in a radial direction, and is opened at front end face 10*a* and a side face 10*b*. In other words, the diameter of the nozzle 10 determines the range of the slit passage 14, particularly the length.

As shown in FIG. 2, the cross sectional shape of the slit passage 14 is an approximate rectangle shape, the depth Dp is 1.2-3 times of the width B. When it is smaller than 1.2 times, the effect to make large the angle of the spray pattern is hard to obtain, and when it is larger than 3 times, the amount of an aerosol composition flowing along the slit passage 14 becomes large, the density of the both ends tends to be thick. The bottom face 14*a* of the slit passage 14 is, as shown in FIG. 3*a*, approximately perpendicular to the axis line of the nozzle 10, and is flat. In addition, the width B of the slit passage 14 is 0.1-1 mm, the depth Dp is the extent of 0.3-3 mm. In this embodiment, the depth Dp of the slit passage 14 is substantially constant, but the width B is taper like somewhat expanding toward the front end from the bottom face. The width of the front end is 1-3 times of the width of the bottom face, preferably 1.2-2.5 times.

The passage 16 is opened at the back portion side in order to be connected with the container body 31 through the push button 11 and the spacer 12. The diameter df of the nozzle hole passage 18 is rather smaller than the inner diameter dt of the passage 16, df/dt=0.1-0.5, preferably 0.2-0.4. And the diameter df of the nozzle hole passage is larger than the width B of the slit passage 14. Hence, the nozzle hole is plugged by the bottom portion 19-except for the slit passage 14. In this embodiment, the bottom face 14*a* of the slit passage 14 and a bottom face (nozzle hole) 18*a* of the nozzle hole passage is made to be an identical plane. Among the bottom face 14*a* of the slit passage 14, the portion overlapping with the nozzle hole is an opening 18*b* opened outside through the slit passage 14 as shown in FIG. 2*b*.

As shown in FIG. 3*a*, an extended line P of inside plane of the taper portion 17 intersects at the taper angle α within the nozzle hole passage 18. Accordingly, among the contents (aerosol composition) passing through the passage 16, the contents flowing in the vicinity of the passage inner wall converges along the taper portion 17, and joins together with the contents flowing in the center portion of the passage 16, the flow velocity thereof increasing in the nozzle hole passage 16. And, it enters into the slit passage 14 while expanding from just before the slit passage 14, and expands in the longitudinal direction of the slit passage 14 smoothly, and is sprayed in the spray pattern expanding thinly at uniform density flatly in three directions as shown in FIG. 1*c*. Then, depending on the spray velocity, when the component in a radially outward direction along the slit passage 14 is large, it is sprayed in a parabolic shape of a large degree of curvature (small curvature radius), and when the forward component is large, it is sprayed in a relatively slender parabolic shape. When the forward speed of spray particles is large, and the spraying is performed at uniform density, since the air of the vicinity of the nozzle hole is engulfed, it is easy to obtain the parabolic shape spray pattern.

As shown in FIG. 1*a*, the nozzle 10 is fitted tightly to a mating hole 21 formed in the spacer 12. The spacer 12 is fitted air-tightly to a connecting hole 22 formed in the front face of the push button 11. The aerosol product E comprises a cylindrical container body 31, an aerosol valve 32 attached to the upper end thereof, an operation member 20 fitted to the stem of the aerosol valve, and an aerosol composition charged in the container body 31. The operation member 20 comprises the above described push button 11, the spacer 12 attached to the push button, and the nozzle 10 fitted and fixed to the front end of the spacer. As any of the container body 31, the aerosol valve 32, and the aerosol composition, that which is publicly known can be used.

The aerosol composition charged in the container body 31 is composed of a concentrate solution in which active ingredients for spraying into atmosphere such as deodorant component, perfume material, insecticidal component, active ingredients for spraying to a fixed surface such as cleaning component, water shedding component, active ingredients for spraying to human body such as ingredient for harmful insect avoidance, antiperspirants, antipruritic component, perfume material are added in a solvent such as ethanol, purified water, kerosene, and a propellant such as liquefied petroleum gas, liquefied gas such as dimethyl ether, hydrofluoroolefin, and compressed gas such as nitrogen gas, carbon dioxide gas. In order to spray with uniform density in mist form at a wide angle for easily obtaining the effect of the nozzle of the present invention, when using liquefied gas as the propellant, it is preferable to use that which contains 30-90 weight %, particularly 40-80 weight % thereof in an aerosol composition. In addition, when using compressed gas as the propellant, it is preferable to pressurize so as to make the pressure in a container to be 0.3-0.8 MPa. Additionally, when combining surface activating agent and water, and spraying in the aspect of spray foam, it is preferable to adopt that in which the liquefied gas is contained 5-40 weight %, particularly 10-30 weight %. When spraying in the aspect of spray foam, since it forms foam on a surface to be coated such as glass and tile, it is easy to check the foam forming the shape of character. Moreover, since the contour portion is pulled inside, wafting and scattering can be prevented, preventing a user from sucking it.

The operation method is same as a conventional aerosol product such as to bear by hand the container body 31, and to push down the upper end of the push button 11. Thereby, the aerosol composition in the container body 31 passes through the stem of the aerosol valve 32, and passes through the spacer 12 from the push button 11, and is sprayed in a mist form via the passage 16, the taper portion 17, the nozzle hole passage 18. And, the sprayed particles are sprayed forward while the spray direction is regulated by the slit passage 14. At this time, in the shape of the spray pattern F, as described above, the shape is of a semi parabolic shape, and the cross sectional shape or the shape viewed from the front is an approximate Y-character shape such that the shape of the slit passage 14 is expanded (refer to FIG. 1*c*). In other words, every sheet has the shape of a contour surrounded by a center line C and a semi parabolic shape H of outer diameter, expressing a plate-like shape having a predetermined thickness. And, as a whole, it has a configuration in which the three sheets of the plate-like spray are arranged around the center line radially. In addition, usually, the parabola is not exactly line symmetry to the center line C, and is of the shape slacking downward by the influence of gravity.

In the sprayed particles sprayed from the nozzle 10, the contour portion of the spray pattern never expand outside linearly, the sprayed particles of the contour portion expand while returning to the center somewhat. Hence, the spray pattern in which the density difference between the center portion and the peripheral portion is small can be obtained. Further, as shown in FIG. 1*c*, since the sprayed particles expand while maintaining a thin plate-like spray pattern, the density difference between the center portion and the peripheral portion is small. Moreover, in the outside of the parabola, usually, sprayed particles running off the flow of the spray pattern waft, but in this embodiment, the contour portion is pulled in toward the center side, wafting spray particles are few. Hence, even when the spray velocity is slow, the backfiring phenomenon is hard to occur.

A nozzle 34 shown in FIG. 5*a* and FIG. 5*b*, is substantially same as the nozzle 10 of FIG. 3*a* and FIG. 3*b* excepting that the slit passage 14 formed in the front face is of an X-character shape or is of a cross shape. To be more precise, it includes the column-like passage 16, the convergent taper portion 17 provided in the front end of the passage 16, the small diameter nozzle hole passage 18 extending from the front end of the taper portion 17, and the slit passage 14 connecting the nozzle hole which is the opening end of the nozzle hole thereof and outside. The slit passage 14 is of a cross shape as shown in FIG. 5*b*.

The spray pattern sprayed from an aerosol product using the nozzle 34 is also, same as the case of FIG. 1*a*, surrounded by a center line and a semi parabolic shape of the outer periphery, and expresses a plate-like shape having a predetermined thickness, being a configuration in which the four plates are arranged around the center line in the shape of a cross (refer to FIG. 5*c*). In this nozzle 34, the density difference between the center portion and the peripheral portion is small. Moreover, in the case of a coating spray, the coating of a modified pattern is possible by one time of spraying. The nozzle 10 of FIG. 1*a* is also same in this point.

A nozzle 36 shown in FIG. 6*a* and FIG. 6*b* is same as the nozzle 10 of FIG. 2*a*, FIG. 2*b* excepting that the slit passage 14 formed in the front face is of the shape of an approximately straight line and is deep. To be more precise, it is equipped with the column-like passage 16, the convergent taper portion 17 provided in the front end of the passage 16, the small diameter nozzle hole passage 18 extending from the front end of the taper portion 17, and the slit passage 14 connecting the nozzle hole which is the opening end of the nozzle hole thereof and an outer space. The slit passage 14 is of a straight line shape as shown in FIG. 6*b*. This can be viewed that one pair of slit passages 14, 14 is arranged symmetrically to the center C of the nozzle. Further, as shown in FIG. 6*a*, the depth Dp of the slit passage 14 is equal to the length of the nozzle hole passage 18, and is rather deep compared with the case of FIG. 3*a*.

The spray pattern sprayed from an aerosol product using the nozzle 36 is also, same as the case of FIG. 1*a*, surrounded by a center line and a semi parabolic shape of the outer periphery, and expresses a plate-like shape having a predetermined thickness, being a configuration in which those plates are arranged interleaving the center line (refer to F of FIG. 6*c*). In the spray by this nozzle 36 also, the density difference between the center portion and the peripheral portion is small. Moreover, since it is of a flat plate-like shape, by moving up and down, or rotating the aerosol product, many different kinds of coating effects can be also brought. Moreover, by the depth Dp of the slit passage 14 being deep, since the scattering effect by the slit passage becomes strong, the expansion of the spray pattern becomes large, but the density of the peripheral portion and the center portion of the spray pattern becomes thin.

Figure 6:
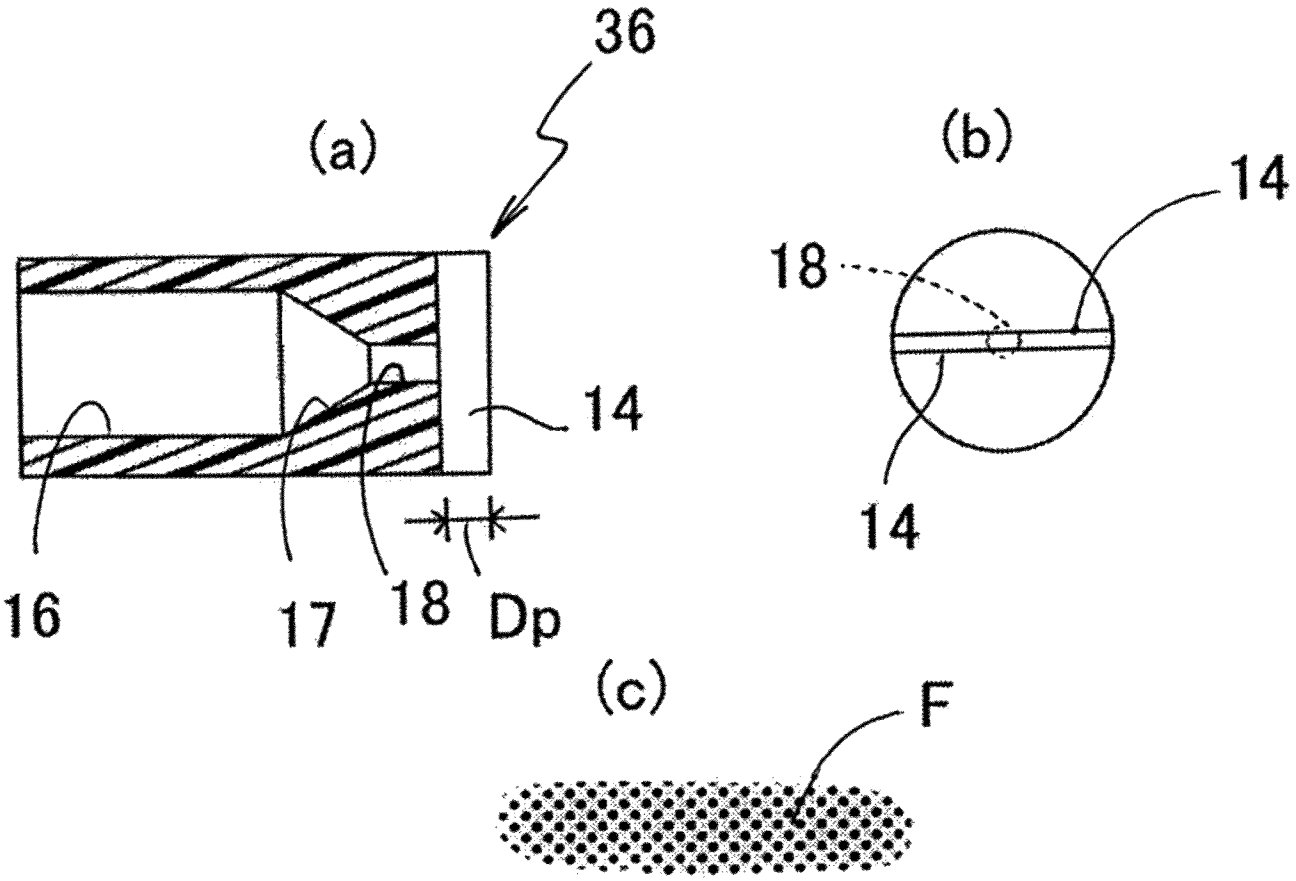
FIG. 6*a* and FIG. 6*b* are respectively a longitudinal cross sectional view and a front elevational view of the other embodiment of the spray nozzle of the present invention.
FIG. 6*c* is a cross sectional view of the spray pattern obtained by the spray nozzle thereof.
Figure 7:
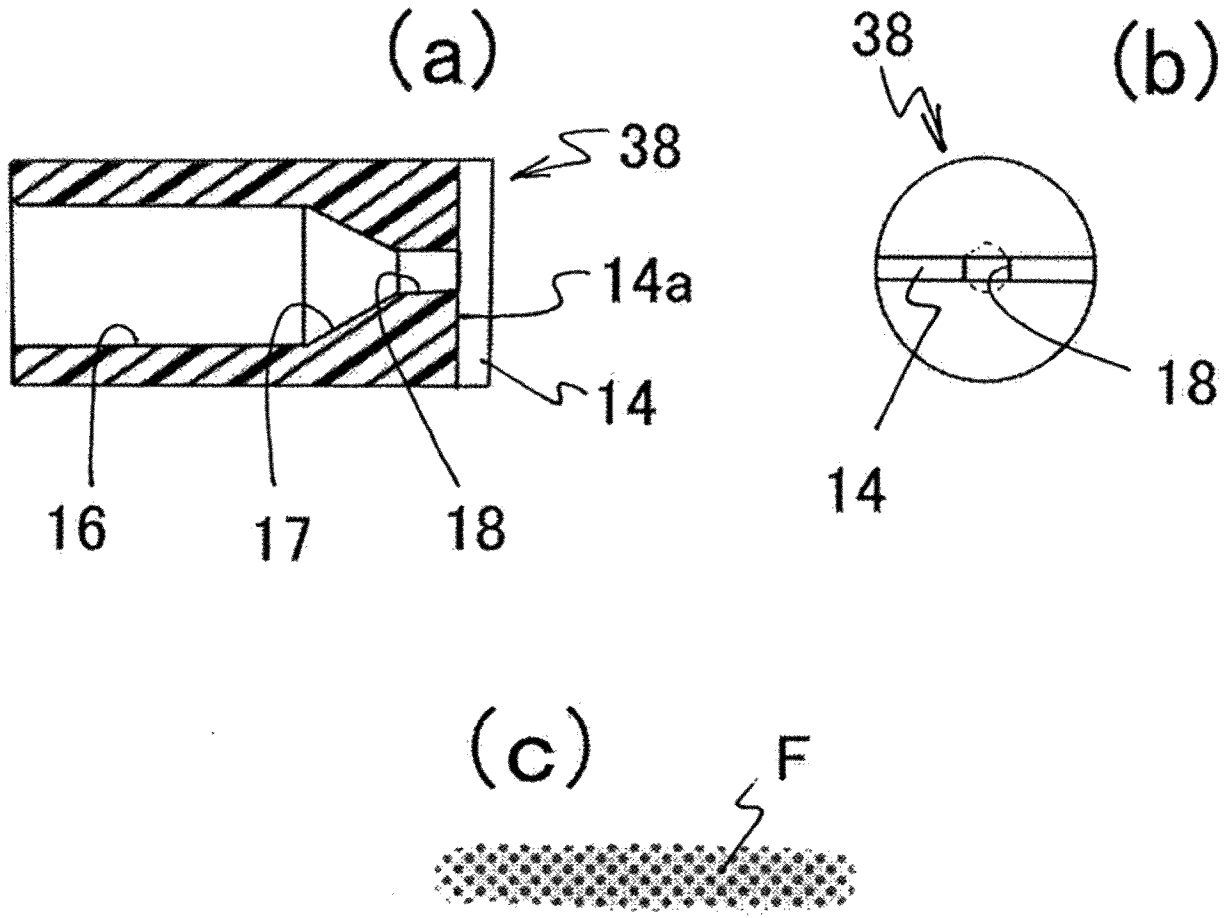
FIG. 7*a* and FIG. 7*b* are respectively a longitudinal cross sectional view and a front elevational view of the other embodiment of the spray nozzle of the present invention.
FIG. 7*c* is a cross sectional view of the spray pattern obtained by the spray nozzle thereof.

A nozzle 38 shown in FIG. 7*a*, FIG. 7*b* is substantially identical with the nozzle 36 of FIG. 6*a*, FIG. 6*b* excepting that the depth Dp of the slit passage 14 is shallow. Since in this nozzle the scattering effect by the slit passage becomes week, the expansion of the spray pattern becomes small, but the density difference between the periphery and the center portion is also small.

In a nozzle 40 shown in FIG. 8*a*, the angle θ of a bottom face 14*a* of the slit passage 14 to the center line C is 90 degrees or more, particularly of the extent of 100-120 degrees. Hence, the angle 20 which is composed by the bottom face 14*a* of the right and left slit passages 14 is larger than 180 degrees, for example, 200-240 degrees. If this nozzle 40 is used, when an aerosol composition is sprayed forward, surrounding air intrudes through the slit passage 14. Accordingly, the spray pattern F expands in a large way engulfing surrounding air into the slit passage, the direction of spray changing. In this nozzle also, the density difference between the center portion and the peripheral portion of the spray pattern F is small, further, the spray pattern becomes large. In addition, three or more than four slit passages 14 may be provided radially around the center line C.

In the above described embodiment, the shape of the slit passage is made to be an aggregate of straight lines extending radially at an equal interval from the center of the nozzle in a front elevational view, but other shapes can be adopted as the nozzle of FIGS. 9*a-f*. In a nozzle 41 shown in FIG. 9*a*, the configuration is made so that right and left slit passages 41*a*, 41*b* extending inversely mutually from the center are smoothly continued at the center. The right and left slit passages 41*a*, 41*b* are connected so as to be overlapped with the nozzle hole passage 18 at the center portion, and curve in a circular arc shape so as to shift right side as it proceeds outwardly from the center. The spray particles which are sprayed passing through such slit passages 41*a*, 41*b* become the spray pattern of a large wave form which is the direct expansion of the slit passage of the wave form in front. Further, since it sprays outwardly swirling in some degree like a tornado, it exerts an effect to expand far. Hence, it has a merit that the spreading property is excellent.

Figure 9:
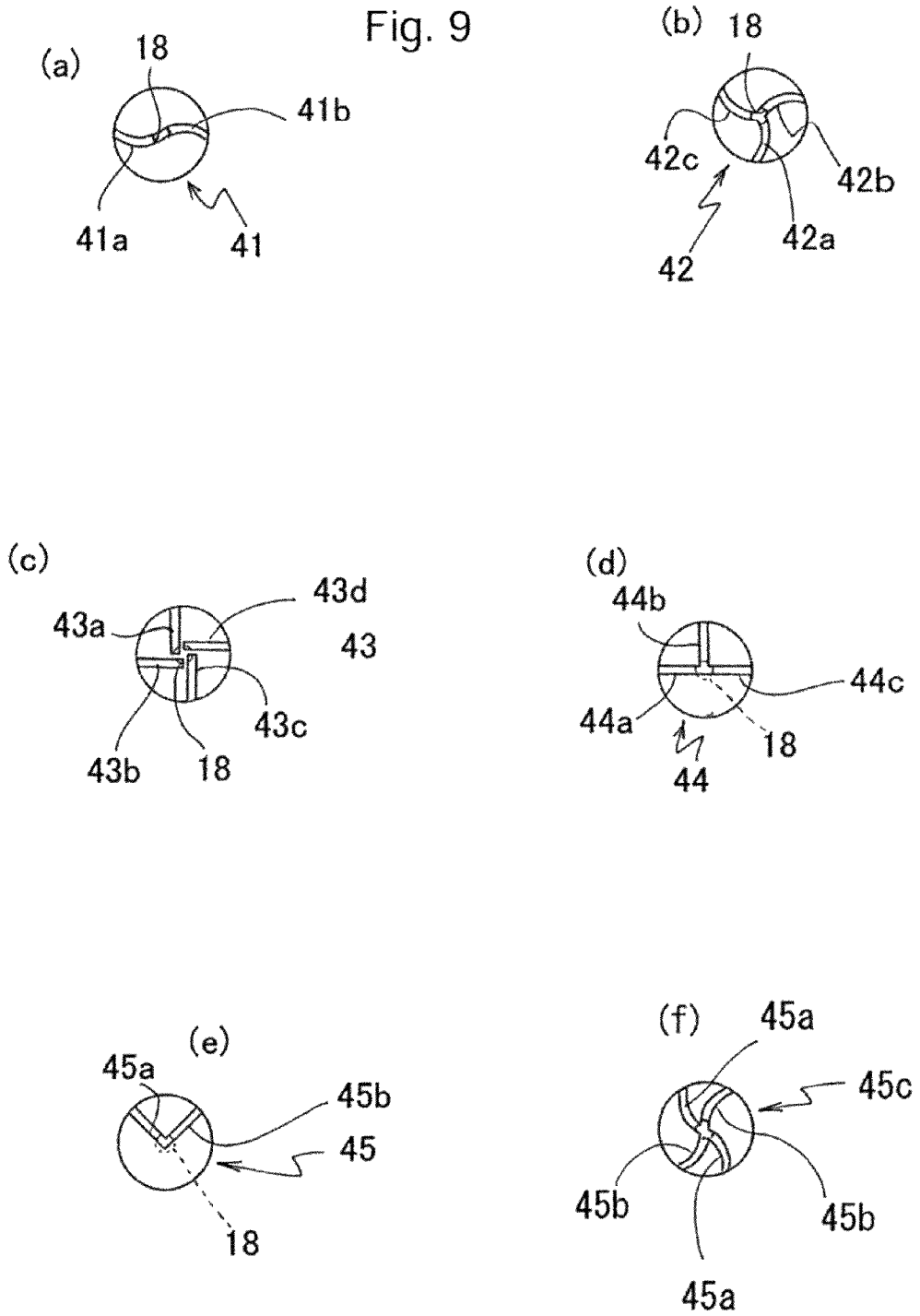
FIGS. 9*a-f* are respectively front elevational views showing further the other embodiment of the spray nozzle of the present invention.

In the nozzle 41 of FIG. 9*a*, that in which two circular arc shape slit passages are combined is adopted, but as a nozzle 42 shown in FIG. 9*b*, that in which three circular arc shape slit passages 42*a*, 42*b*, 42*c* are combined so as to be like a propeller may be adopted. This is excellent in the spreading property, because it swirls more easily than the nozzle of FIG. 9*a*.

A nozzle 43 of FIG. 9*c* uses a pattern in which four line segment-like slit passages 43*a*, 43*b*, 43*c*, 43*d* are arranged like a fylfot. The center portion of any of each slit passage 43*a-d* is overlapped with the nozzle passage 18, and is connected with the interior of the nozzle hole passage thereof. Such nozzle 43 exerts nearly identical effects with the nozzle 34 equipped with the cross shape slit passage of FIG. 5, although the size of the parabola becomes small, since the sprayed particles expand while swirling somewhat, it has a merit to expand far.

Figure 5:
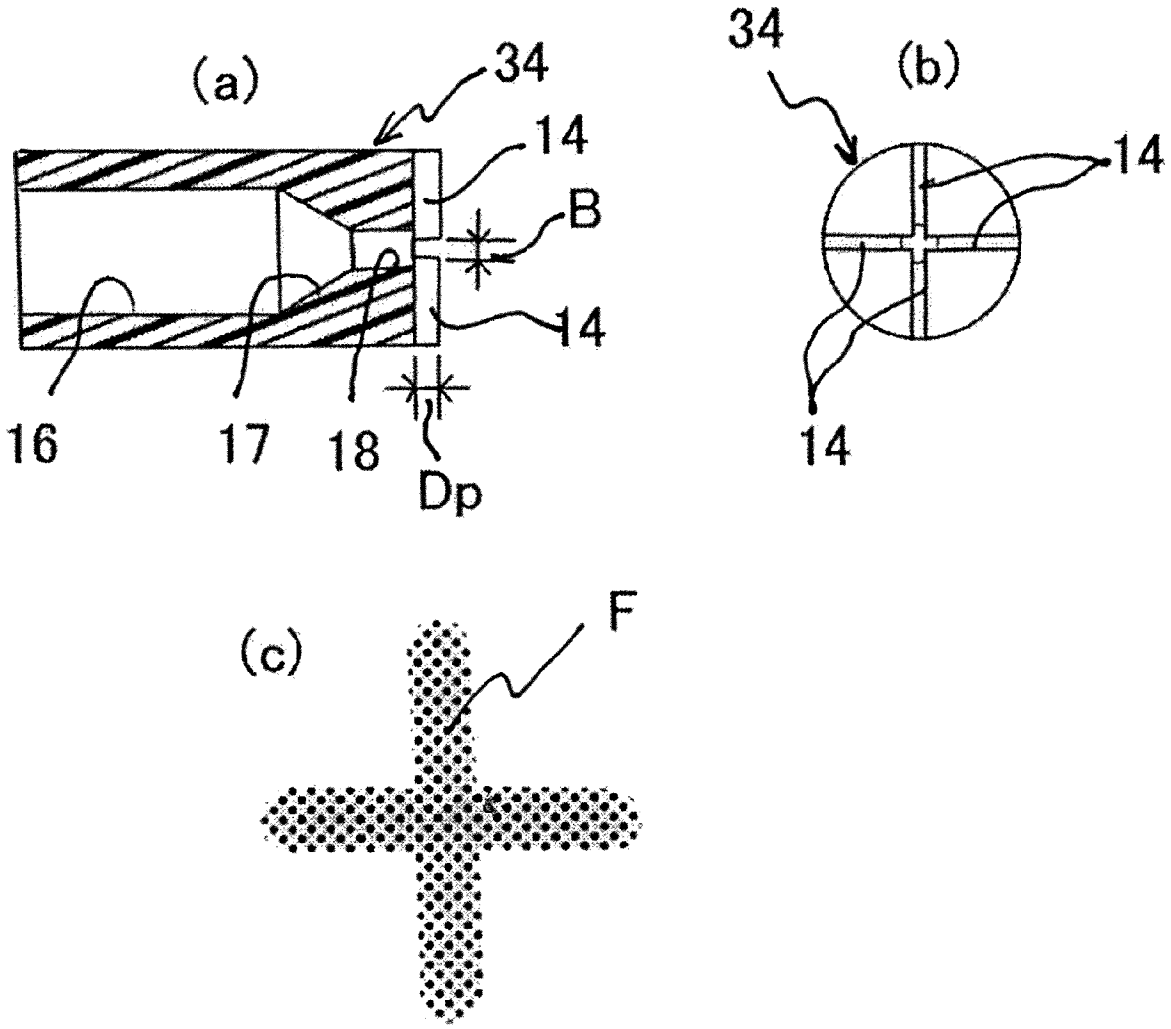
FIG. 5*a* and FIG. 5*b* are respectively a longitudinal cross sectional view and a front elevational view of the other embodiment of the spray nozzle of the present invention.
FIG. 5*c* is a cross sectional view of the spray pattern obtained by the spray nozzle thereof.

A nozzle 44 of FIG. 9*d* is that in which slit passages 44*a*, 44*b*, 44*c* are constituted by remaining three slits excepting a downward passage among the cross shaped slit of the nozzle 34 of FIG. 5.

In a nozzle 45 of FIG. 9*e*, slit passages 45*a*, 45*b* compose a V-character shape extending in two directions making the nozzle hole passage 18 to be a base point. In this configuration, spraying is performed upward from the nozzle passage passing through the two slit passages. Hence, this is preferable to be adopted when downward spraying is not desired. Thus, the spray pattern can be controlled by making the slit passage open upward only, or open downward only.

A nozzle 45*c* of FIG. 9*f* is that in which V-character shaped slit passages 45*a*, 45*b* are curved in some degree in the same direction, further, the one pair of upper and lower V-character shaped slits are arranged in approximate rotation symmetry in regard to the nozzle hole passage 18. The spray pattern obtained by this nozzle 45*c* is such that spraying is performed respectively in the two directions to which the V-character faces. And, since the slit passages 45*a*, 45*b* are curved, the sprayed particles expand, while swirling in some degree, it has a merit of expanding far.

Figure 10:
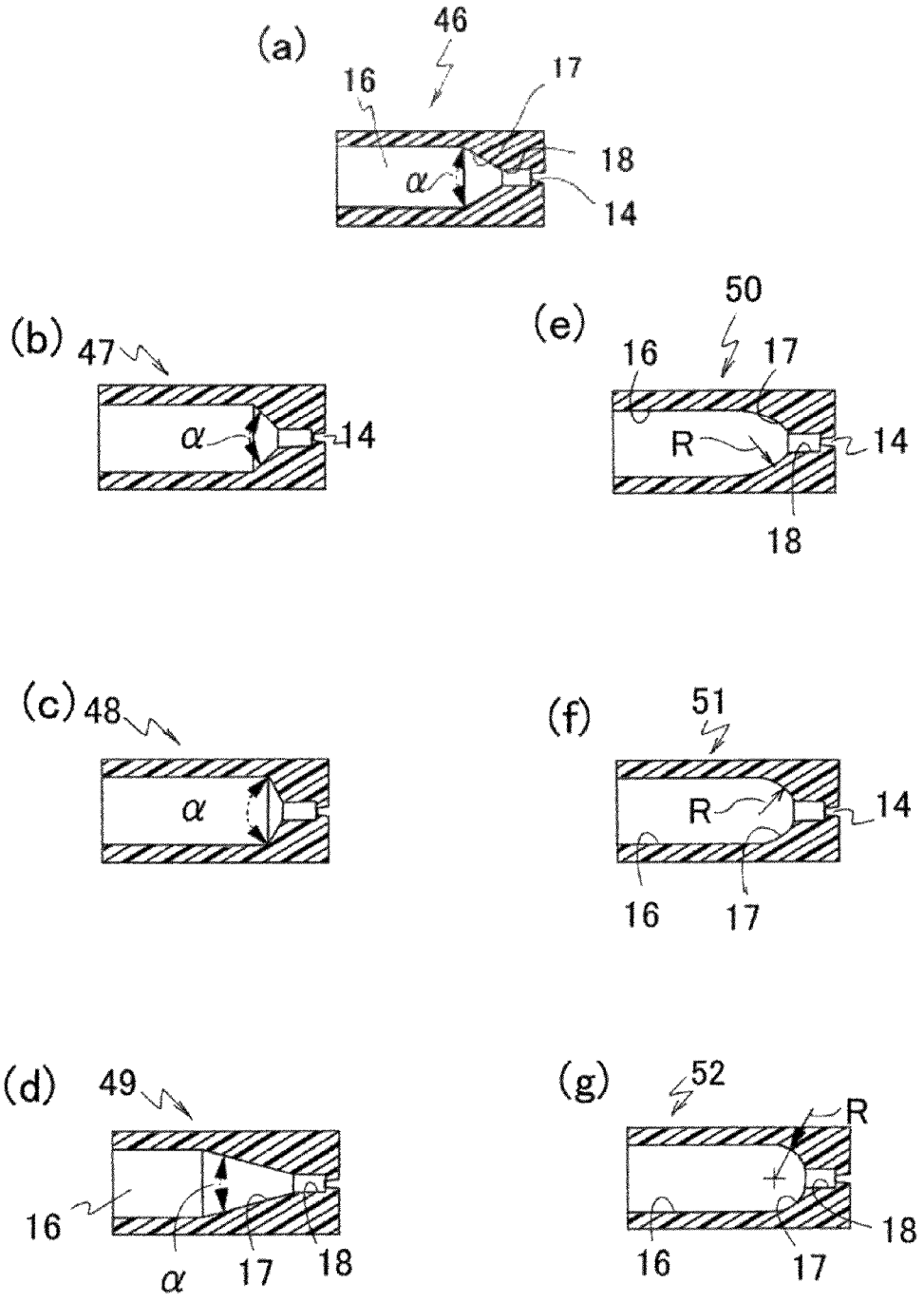
FIGS. 10*a-g* are respectively cross sectional views showing further the other embodiment of the spray nozzle of the present invention.

FIG. 10*a*, FIG. 10*b*, FIG. 10*c*, and FIG. 10*d* are those in which the taper angle α of the taper portion 17 is changed. The taper angle α of a nozzle 46 of FIG. 10*a* is 60 degrees, in a nozzle 47 of FIG. 10*b*, 90 degrees, in a nozzle 48 of FIG. 10*c*, 120 degrees, in a nozzle 49 of FIG. 10*d*, 30 degrees are adopted. When the taper angle α of the taper portion 17 is narrower than 30 degrees, the spray pattern is wide, but since the density in the center portion becomes high and the density gradient becomes large, the contour portion of the spray pattern tends to be a moderate parabola being near linear (refer to Table 1). Moreover, when the taper angle α of the taper portion 17 is wider than 120 degrees, the spray pattern becomes narrow, and since the density of the center portion becomes high and the density gradient becomes large, the contour portion of the spray pattern tends to be a moderate parabola being near linear.

TABLE 1

| | Angle α (degree) of Taper portion | Density Difference | Spray Pattern |
|---|---|---|---|
| FIG. 10a | 60 | None | Parabola |
| FIG. 10b | 90 | None | Parabola |
| FIG. 10c | 120 | Being somewhat dense in the center portion | Moderate parabola |
| FIG. 10d | 30 | Being somewhat dense in the center portion | Moderate parabola |

About the density difference, the density in the center portion and the peripheral portion is compared, when 50 weight % of ethanol, 50 weight % of liquefied petroleum gas are charged as the content and sprayed on a paper reactive with ethanol. About the spray pattern, the cross section of the spray pattern is evaluated by spraying the content, the spray being irradiated with a laser.

On the other hand, nozzles 50, 51, 52 of FIGS. 10*a-g* are all equipped with the taper portion (or shoulder portion) 17 of which the cross section is like a circular arc. The taper portion 17 in the nozzle 50 of FIG. 10*e* has a semi-elliptical cross section, the curvature becomes large as it becomes the nozzle 51 of FIG. 10*f*, the nozzle 52 of FIG. 10*g*. In addition, in the nozzle 52 of FIG. 10*g*, the curvature R is 1.5 mm. If the curvature of the taper portion is small, the spray pattern becomes a moderate parabola being near linear (refer to Table 2).

TABLE 2

| | Shape of Taper portion | Density Difference | Spray Pattern |
|---|---|---|---|
| FIG. 10e | Semi-ellipse (Curvature small) | Being dense in the center portion | Moderate Parabola |
| FIG. 10f | Semi-sphere | None | Parabola |
| FIG. 10g | Semi-ellipse (Curvature large) | None | Parabola |

Nozzles 53-56 of FIGS. 11*a-d* are four kinds of nozzles of which the length and the inner diameter of the nozzle hole passage 18 are changed. The other portions (the inner diameter of the passage is 3.0 mm, the angle of the taper portion is 60 degrees, the length of the taper portion is 2.0 mm, the width of the front end of the slit passage is 0.45 mm, the width of the bottom face is 0.3 mm, the depth of the slit passage is 0.6 mm) are substantially identical mutually. In the nozzle 53 of FIG. 11*a*, the diameter of the nozzle hole passage 18 is 0.85 mm, the length is 1.45 mm. In the nozzle 54 of FIG. 11*b*, the diameter of the nozzle hole passage 18 is 0.85 mm, the length is 0.75 mm. In the nozzle 55 of FIG. 11*c*, the diameter of the nozzle hole passage 18 is 0.85 mm, the length is 2.95 mm. In the nozzle 56 of FIG. 11*d*, the diameter of the nozzle hole passage 18 is 0.4 mm, the length is 1.05 mm. When the ratio of the length of the taper portion and the nozzle hole passage are small, the contour portion of the spray pattern becomes a moderate parabola being near linear. Moreover, also when the ratio of the diameter of the nozzle hole passage and the passage are small, the contour portion of the spray pattern becomes a moderate parabola being near linear (refer to Table 3).

TABLE 3

Figure 11:
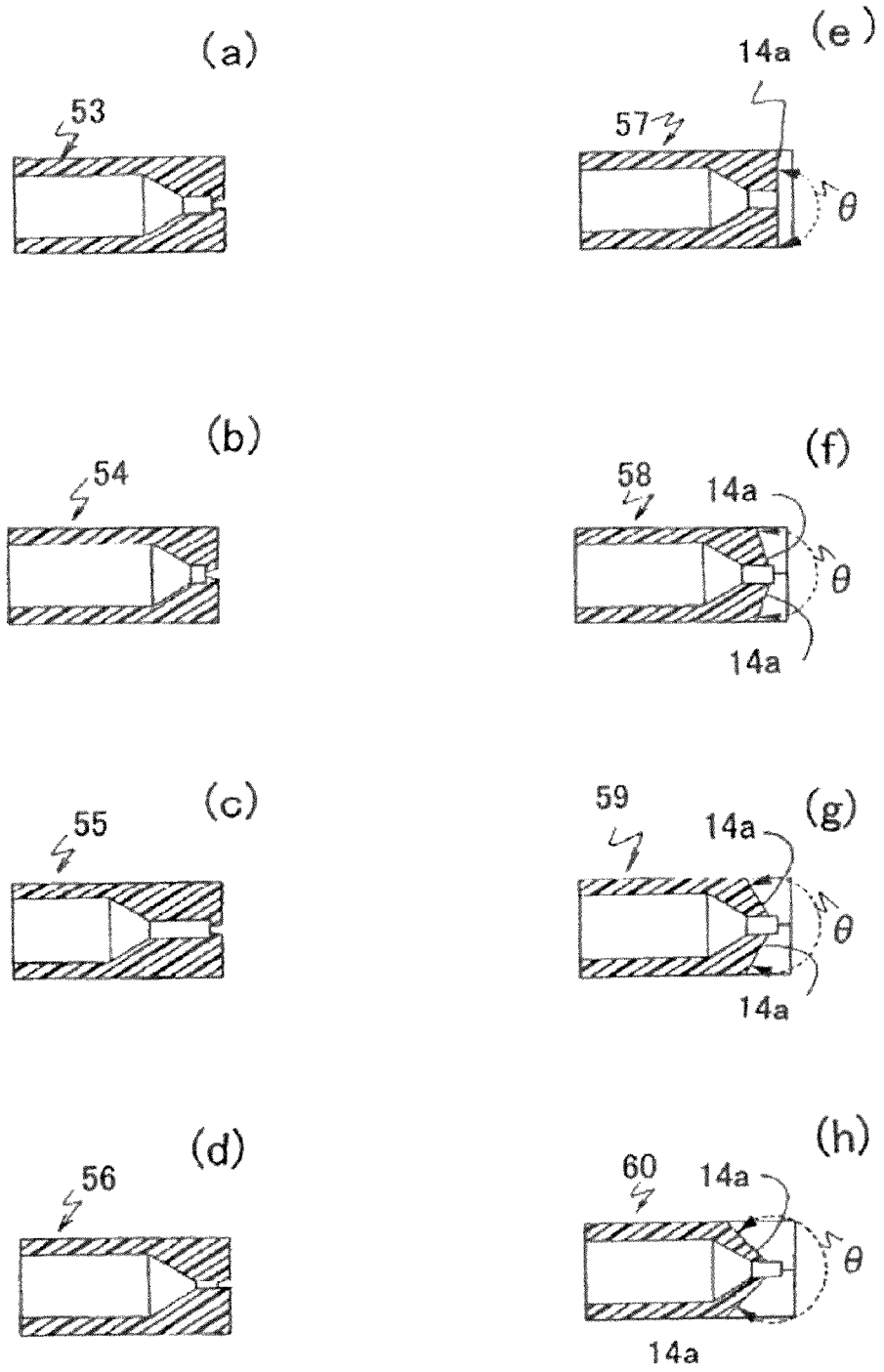
FIGS. 11*a-h* are respectively cross sectional views showing further the other embodiment of the spray nozzle of the present invention.

| | Length ratio of taper portion/ nozzle hole passage | Inner diameter ratio of nozzle hole passage/ passage | Density difference | Spray pattern |
|---|---|---|---|---|
| FIG. 11a | 1.38 | 0.28 | None | Parabola |
| FIG. 11b | 2.67 | 0.28 | None | Parabola |
| FIG. 11c | 0.68 | 0.28 | Being somewhat dense in the center portion | Moderate Parabola |
| FIG. 11d | 1.90 | 0.13 | Being somewhat dense in the center portion | Moderate Parabola |

Nozzles 57-60 of FIGS. 11*e-h* show four kinds of nozzles in which the angle of the bottom face 14*a* of the slit passage 14 is changed. The other portions are identical with FIG. 11*a*. In the nozzle 57 of FIG. 11*e*, the slit passage 14 is not angled and is made to be 180 degrees. In the nozzle 58 of FIG. 11*f*, the angle of the upper and lower slit passage is 216 degrees, in the nozzle 59 of FIG. 11*g*, 240 degrees, in the nozzle 60 of FIG. 11*h*, 270 degrees are adopted respectively. When the angle of the slit passage 14 becomes large, the amount of air engulfed from a surrounding area increases, and the spray pattern becomes large. In addition, if the angle becomes 270 degrees, the spray pattern becomes a moderate parabola (refer to Table 4).

TABLE 4

| | Angle (degree) of bottom face of the slit passage | Density Difference | Spray Pattern |
|---|---|---|---|
| FIG. 11e | 180 | None | Parabola |
| FIG. 11f | 216 | None | Parabola |
| FIG. 11g | 240 | None | Parabola |
| FIG. 11h | 270 | None | Moderate Parabola |

Nozzles 61-64 of FIGS. 12*a-d* have an approximately column like configuration, and is characterized in that a center line Cf of the nozzle hole passage 18 is decentered toward downside from the center line of the nozzle. Thereby, the taper portion 17 smoothly connecting the passage 16 and the nozzle passage 18 of which the diameter is smaller than it is made to be a decentered configuration. The reason why the nozzle hole passage 18 is made to decenter is that, as known from FIGS. 12*f-i*, the shape of the slit passage 14 viewed from the front is curved in a large way or inflected.

Figure 12:
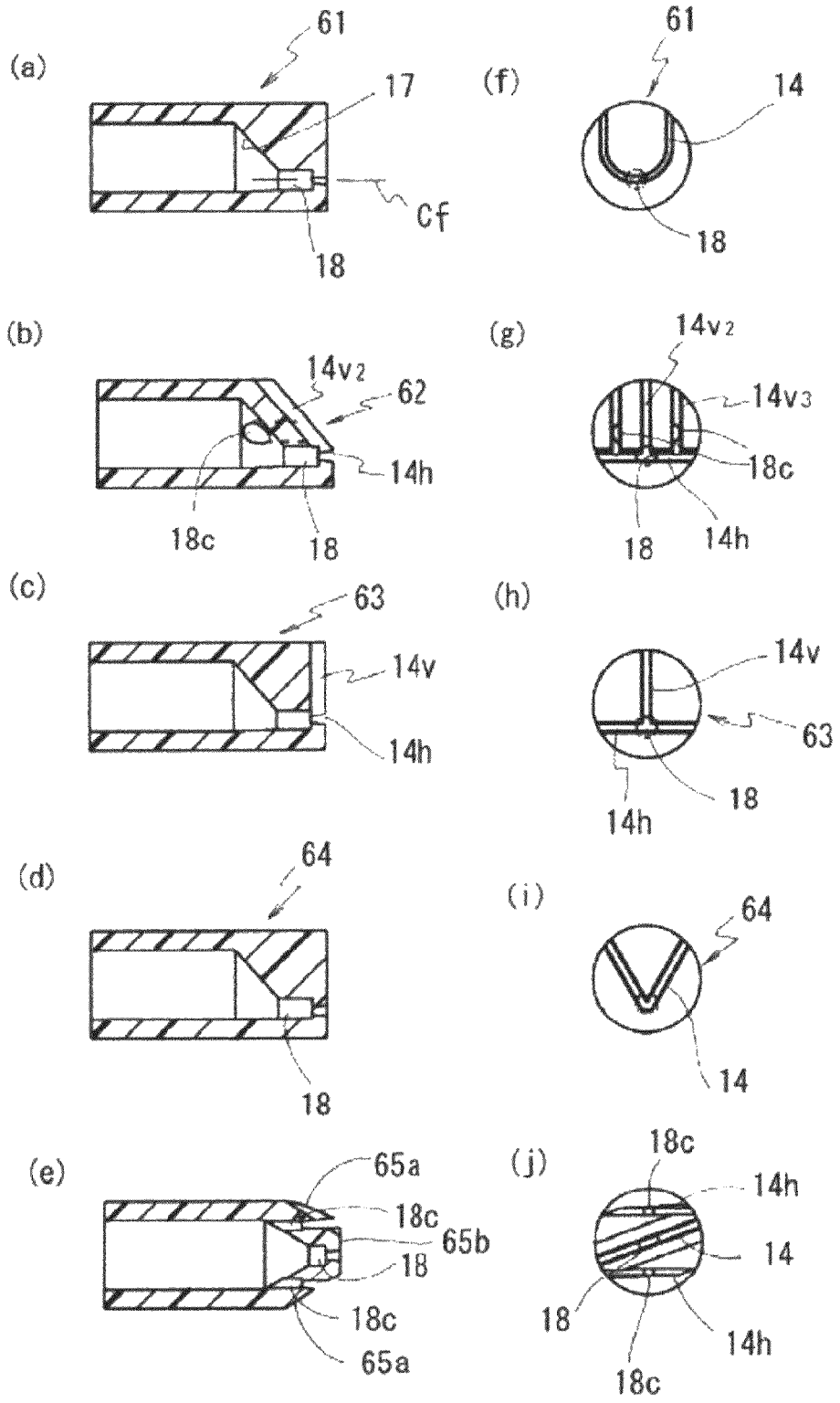
FIGS. 12*a-e* are respectively cross sectional views showing further the other embodiment of the spray nozzle of the present invention.
FIGS. 12*f-j* are respectively front elevational views of those spray nozzle.
Figure 16:
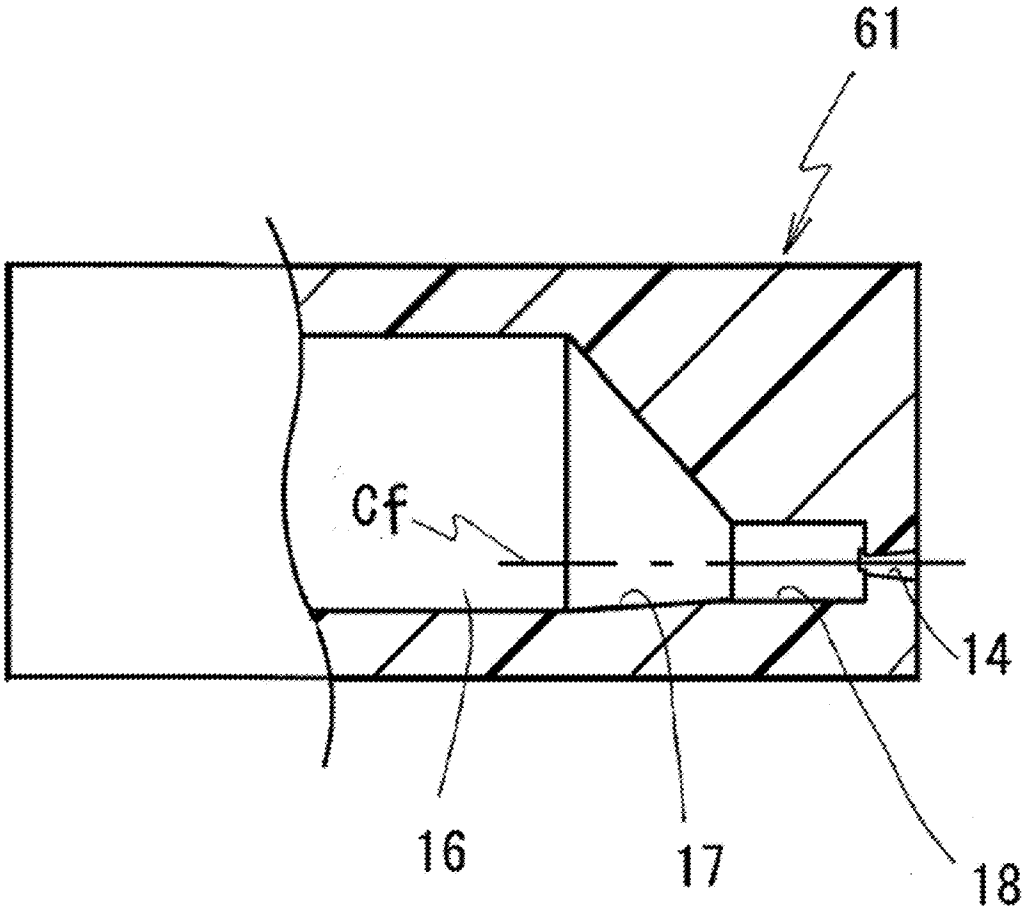
FIG. 16*a* and FIG. 16*b* are respectively enlarged views of FIG. 12*a* and FIG. 12*f;*
Figure 16:
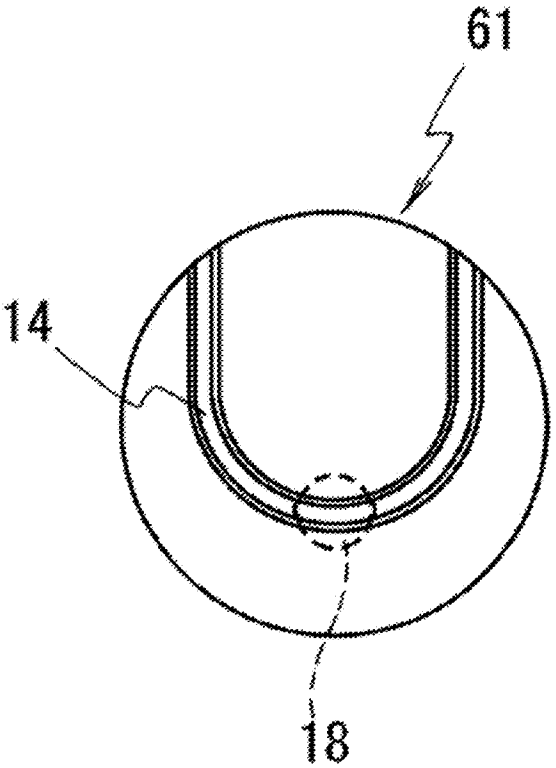

In a nozzle 61 of FIG. 12*a*, as known from FIG. 12*f*, the slit passage 14 expresses an approximate U-character shape, and does not pass through the vicinity of the center. And, as shown in FIG. 16*a*, FIG. 16*b*, the nozzle hole passage 18 is provided in the center of right and left of the bilaterally symmetric slit passage 14. The end portion (upper end of FIG. 12*f*) of the slit passage 14 is opened in the outer peripheral surface of the nozzle 61.

A nozzle 62 of FIG. 12*b* is, as known from FIG. 12*g*, equipped with one laterally-facing slit passage 14*h* of which the both ends are opened in the outer peripheral surface of the nozzle 61, and three longitudinal slit passages 14*v*1, 14*v*2, 14*v*3 of which the lower end is connected with the laterally-facing slit passage 14*h*, and the upper end is opened in the outer peripheral surface of the nozzle. Thereby, the spray pattern expresses approximately the shape of "mountain" or "E". And, in the lower end of the central longitudinally facing slit passage 14*v*2, a main nozzle hole passage 18 is opened. And, a sub nozzle hole passage 18*c* is opened in a somewhat upper portion than the lower end of the right and left longitudinally facing slit passages 14*v*1, 14*v*3. Further, in an upper side than the laterally facing slit passage 14*h*, in other words, in an area where the longitudinally facing slit passages 14*v*1-3 are provided, the front face of the nozzle 61 backs away as it goes upward. The gradient plane is substantially flat.

In this nozzle 62, since the main nozzle hole passage 18 is provided in the lower end of the central longitudinally facing slit passage 14*v*2, those slit passages 14*v*2, 14*h* extend straightly to outside from the nozzle hole passage 18, and are not inflected strongly in the middle. Thereby, it is possible to spray outside smoothly through both of the longitudinally facing central slit passage 14*v*2 and the laterally facing slit passage 14*h*. On the other hand, the right and left longitudinally facing slit passages 14*v*1, 14*v*3 are inflected to the laterally facing slit passage 14*h*, but since there is the sub nozzle hole passage 18*c*, the spray through those is smooth. In this nozzle 62, since the upper portion of the front face of the nozzle 62 is inclined so as to back away, the length of the sub nozzle hole passage 18*c* extending from the middle of the taper portion 17 to outside becomes short, and since the position of the nozzle hole is not lined up in the direction of the flow within the nozzle, the sprayed object from the main nozzle hole passage 18 and the sub nozzle hole passage 18*c* are partitioned not interfering mutually, the spray pattern of desired shape can be obtained.

A nozzle 63 of FIG. 12*c*, FIG. 12*h* is equipped with one laterally facing slit passage 14*h* of which the both ends are opened in the outer peripheral surface of the nozzle 63, and a longitudinally facing slit passage 14*v* of which the lower end is connected to the laterally facing slit passage 14*h* and the upper end is opened in the outer peripheral surface. Stated differently, the right and left longitudinally facing slit passages 14*v*1, 14*v*3 are omitted from the nozzle 61 of FIG. 12*b*, making it as a T-character like slit passage. The nozzle hole passage 18 is opened in a position where the both slit passages 14*h*, 14*v* intersect.

In a nozzle 64 of FIG. 12*d*, FIG. 12*i*, the slit passage 14 is like a V-character shape. Compared with the nozzle 45 of FIG. 9*e*, in the nozzle 45 of FIG. 9*e*, the lower end of the V-character is approximately in the center of the nozzle, but in the nozzle 64 of FIG. 12*d*, it is decentered downward from the center of the nozzle, where the angle composed by the two line segments is about 60 degrees, which is the different point. Hence, "V" is arranged nearly the center of the front face of the nozzle, forming the shape near a V-character of alphabet. Other points are substantially identical. The nozzle hole passage 18 is opened at the position where two line segments intersect.

In a nozzle 65 of FIG. 12*e*, FIG. 12*j*, the main nozzle hole passage 18 is provided in the approximate center of the nozzle, the oblique slit passage 14 connected with the main nozzle hole passage 18 is formed in the front face of the nozzle 65. Further, from the middle of the interior taper portion 17, a sub nozzle hole passage 18*c* is formed apart in some degree from the main nozzle hole passage 18. Those sub nozzle hole passages 18*c* are connected with the laterally extending upper and lower slit passages 14*h*, 14*h* in the front face of the nozzle. Thereby, since the position of the slit passage is not lined up, the spray object from each slit passage is partitioned not interfering mutually, making the spray pattern sprayed from this nozzle 65 to be an approximate Z-character shape. In addition, the upper portion and the lower portion of the front face of the nozzle 65 is made to be a flat gradient plane 65*a* nearly identical with the taper angle of the taper plane so as not to make the sub nozzle hole passage 18*c* long.

The center portion of the front face of the nozzle 65 is made to be a flat plane 65*b* perpendicular to the axis. The flat plane 65*b* is, as shown in FIG. 12*j*, is provided in the both sides of the oblique slit passage 14 with a certain width. The ridge line of the border of the flat plane 65*b* and the gradient plane 65*a* is in parallel to the oblique slit passage 14, the gradient plane 65*a* backs away along a perpendicular direction to those ridge lines.

Figure 13:
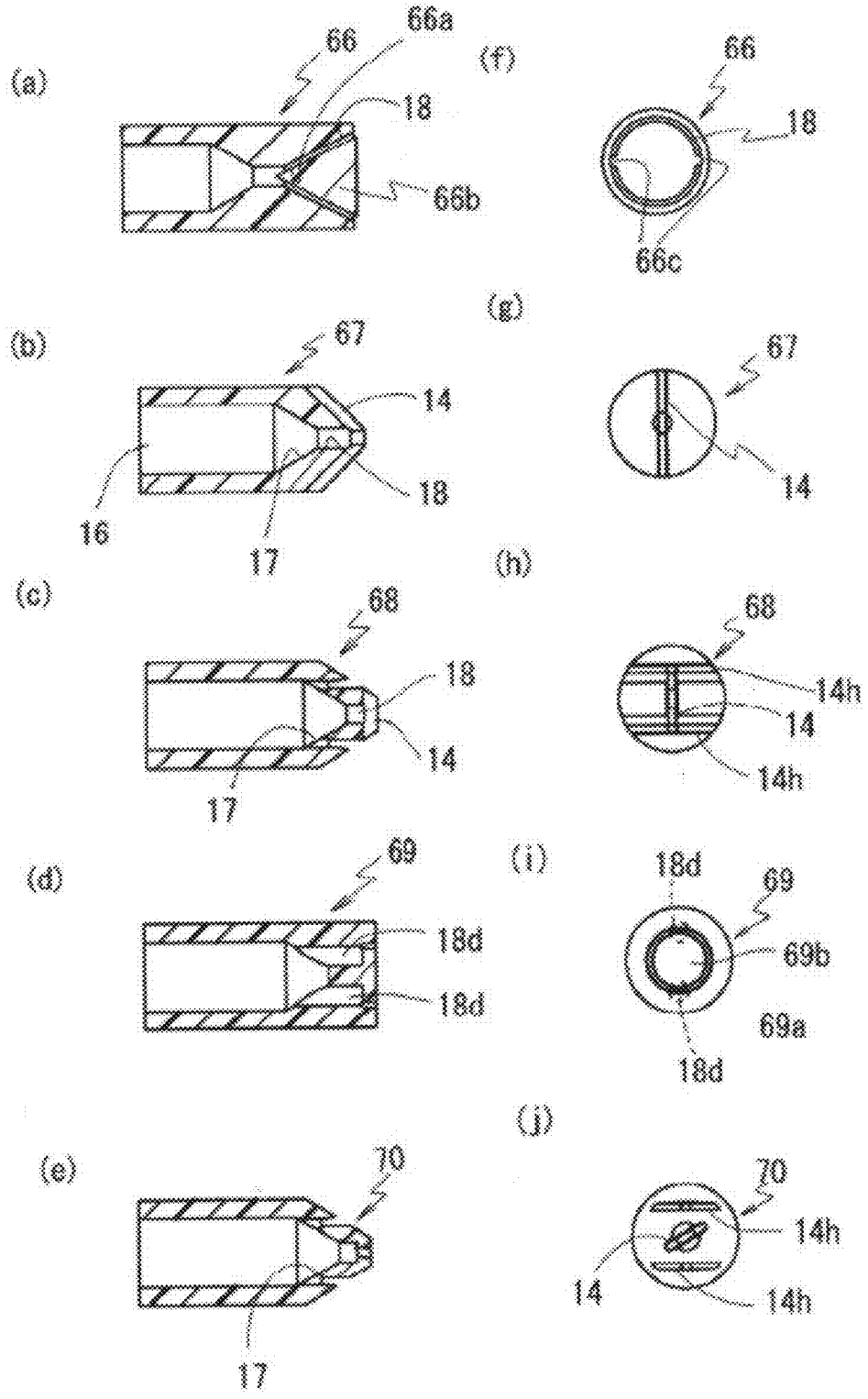
FIGS. 13*a-e* are respectively cross sectional views showing further the other embodiment of the spray nozzle of the present invention.
FIGS. 13*f-j* are respectively front elevational views of those spray nozzle.
Figure 17:
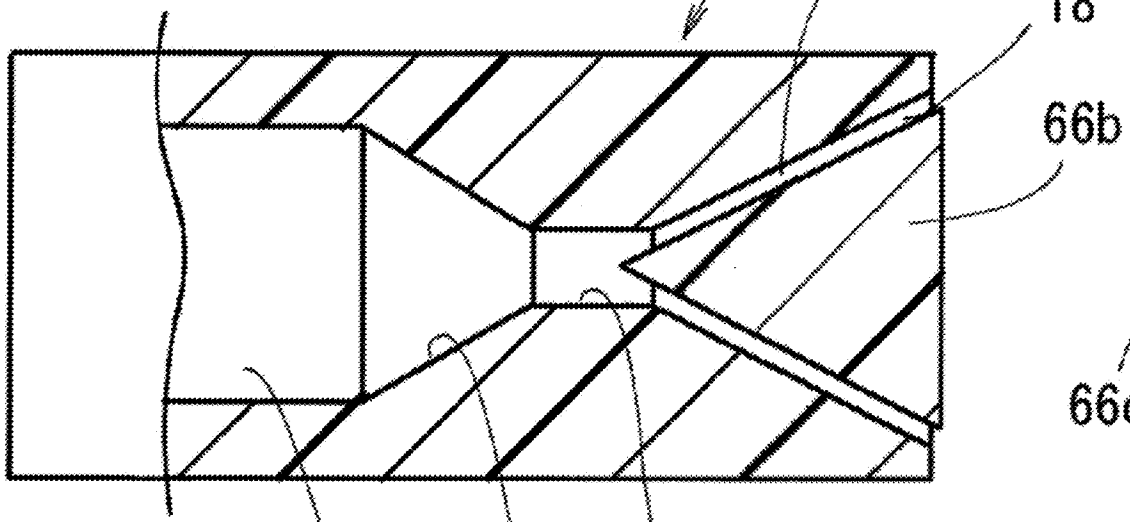
FIG. 17*a* and FIG. 17*b* are respectively enlarged views of FIG. 13*a* and FIG. 13*f;*
Figure 17:
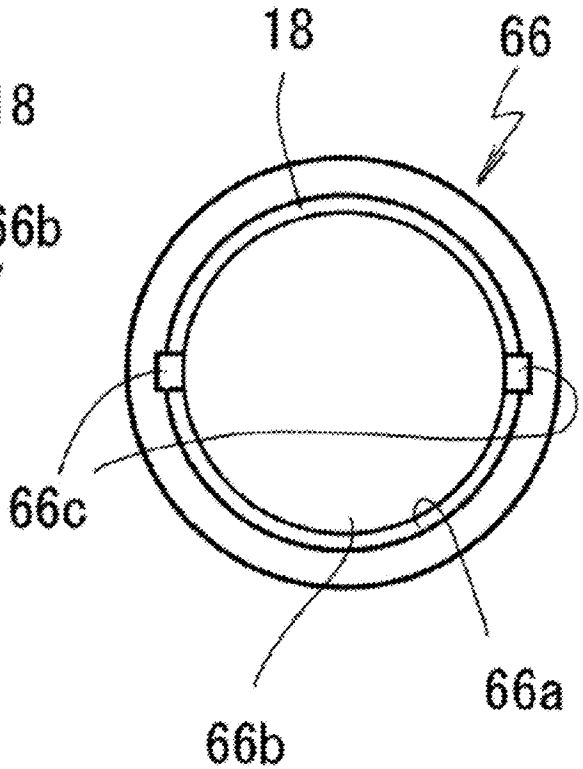

A nozzle 66 of FIG. 13*a*, FIG. 13*f* has the nozzle passage 18 of an approximate circular conical surface shape. Such circular conical surface shape nozzle hole passage 18 is formed of a concave portion 66*a* of a conical shape expanding toward the front end formed in the front face of the nozzle 66, and a plugging member 66*b* like a circular conic body arranged so as to form a gap between itself and the inner face of the concave portion thereof. In order to hold the plugging member 66*b*, as shown in FIG. 17*a*, FIG. 17*b* in detail, by connecting branches 66*c* of right and left two places, the plugging member 66*b* and the other portion of the nozzle are connected. By a 3D printer of synthetic resin or by solid fabrication, the plugging member 66*b* can be shape-formed integrally with other portions, but when in mass production, it is manufactured as a separate part, and is integrated using an adhesive etc. This nozzle 66 can spray in the pattern of an approximate circle or an "O" character shape of alphabet.

In a nozzle 67 shown in FIG. 13*b*, FIG. 13*g*, the front face is formed to be taper-like, the slit passage 14 is formed in a vertical direction along the taper plane. The angle of the taper plane is made to be nearly identical with the taper angle of the taper portion 17 continuing to the interior passage 16. The slit passage 14 is linear vertically viewed from the front. This is nearly same as the nozzle 36 of FIG. 6*a, b*, the nozzle 38 of FIG. 7*a, b*, or the nozzle 40 of FIGS. 8*a-c*. Moreover, the point that the bottom face of the slit passage 14 is inclined so as to back away is same as the nozzle 40 of FIGS. 8*a-c*. However, in the nozzle 40 of FIGS. 8*a-c*, the depth of the slit passage 14 becomes deep gradually as it goes toward outside, in the nozzle 67 of FIG. 13*b*, FIG. 13*g*, the front face is made to be taper-like, where the depth of the slit passage 14 is nearly uniform.

A nozzle 68 shown in FIG. 13*c*, FIG. 13*h* is that in which the main oblique slit passage 14 of nozzle 65 of FIG. 12*e*, FIG. 12*j* is made to be a longitudinally facing slit passage 14*v*. Stated differently, the sub nozzle hole passage 18*c* extending forward from the middle of the taper portion 17 is formed to be a pair in parallel to the center axis being apart from the center axis. Those sub nozzle hole passages 18*c* are opened at the center of right and left of the upper and lower slit passages 14*h*, 14*h* extending laterally in the nozzle front face. And, between the centers of the upper and lower slit passages 14*h*, 14*h* is connected by the slit passage 14*v*. The front end of the main nozzle hole passage 18 is opened outside at the upper and lower center of the slit passage 14*v* of a longitudinal direction. Thereby, the spray pattern sprayed from this nozzle 64 becomes an approximate H-character shape. In addition, so as not to make the sub nozzle hole passage 18*c* long, the upper side and the lower side is made to be a backing away gradient plane excepting the flat portion of the front face of the nozzle. The angle of the gradient plane is substantially identical with the taper angle of the taper portion 17 of the internal cavity.

In a nozzle 69 of FIG. 13*d*, FIG. 13*j*, a pair of the nozzle hole passages 18*d* is formed, being decentered vertically from the center of the nozzle. On the other hand, in the front face side of the nozzle, a cylindrical concave portion 69*a* is formed, inside of the concave portion thereof, a circular plate-like plugging member 69*b* is arranged through a gap between itself and the inner face of the concave portion. This circular ring-like gap serves as the slit passage 14. And, the front end of the above described nozzle passage 18*d* is almost plugged with the plugging member 69*b*, but is connected at a part. This can spray with an approximately circular spray pattern.

Figure 18:
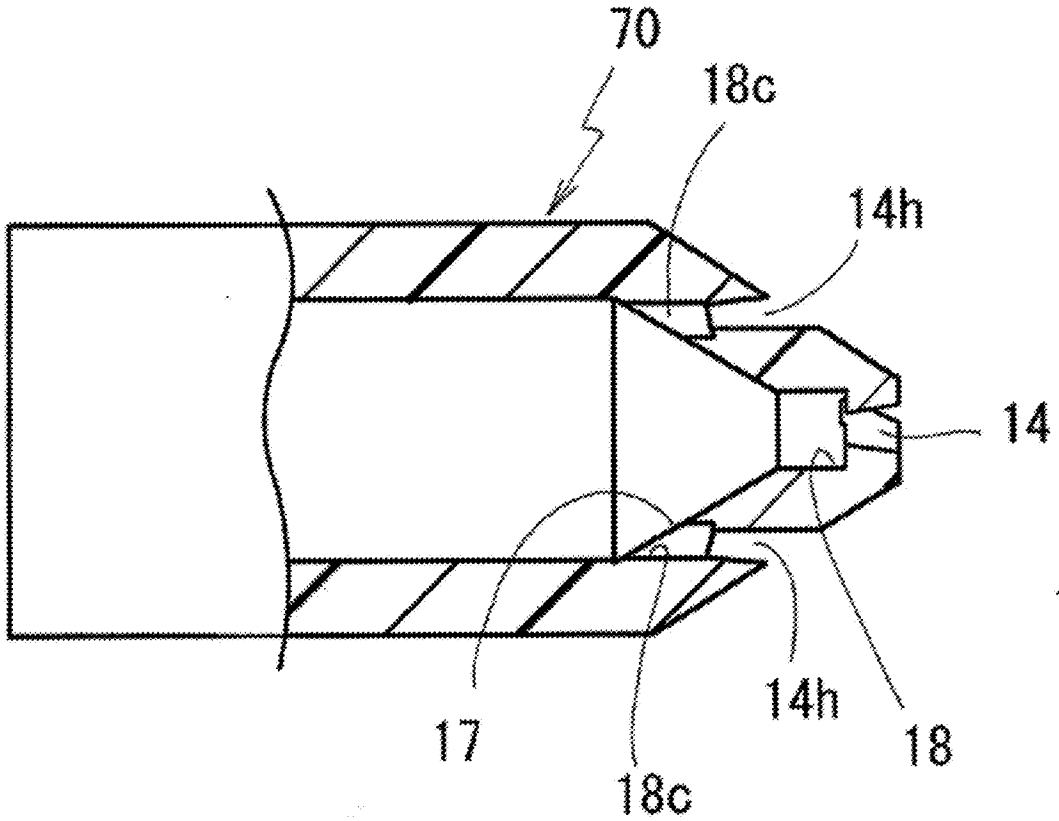
FIG. 18*a* and FIG. 18*b* are respectively enlarged views of FIG. 13*e* and FIG. 13*j;*
Figure 18:
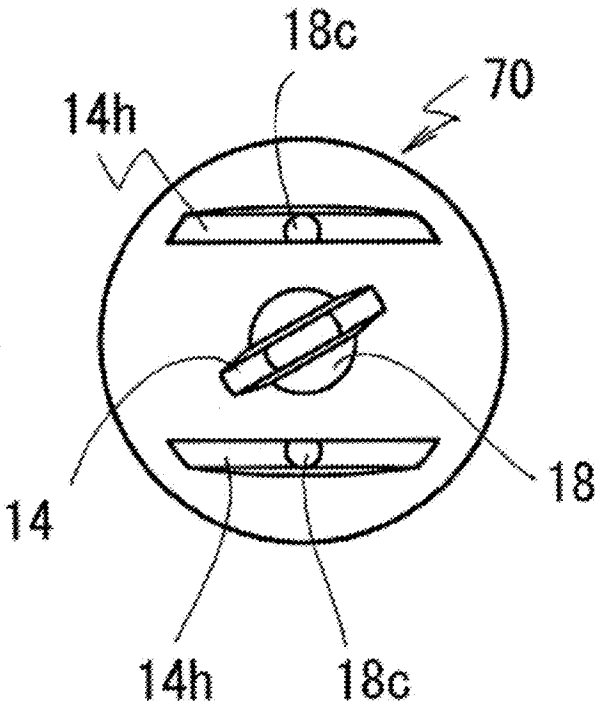

A nozzle 70 of FIG. 13*e*, FIG. 13*j* is nearly same as the nozzle 65 of FIG. 12*e*, but the front face is formed of a central circular flat portion and a circular truncated cone portion around thereof. The taper angle of the circular truncated cone is nearly identical with the taper angle of the interior taper portion. As found from FIG. 18*a*, FIG. 18*b*, the main slit passage formed to be oblique and the horizontal sub nozzle hole passage 18*c* are cut in from the front face side of the nozzle, and do not reach the outer peripheral surface of the nozzle, when viewed from the front. The spray pattern of this nozzle 70 viewed from the front is of a Z-character shape.

Figure 3:
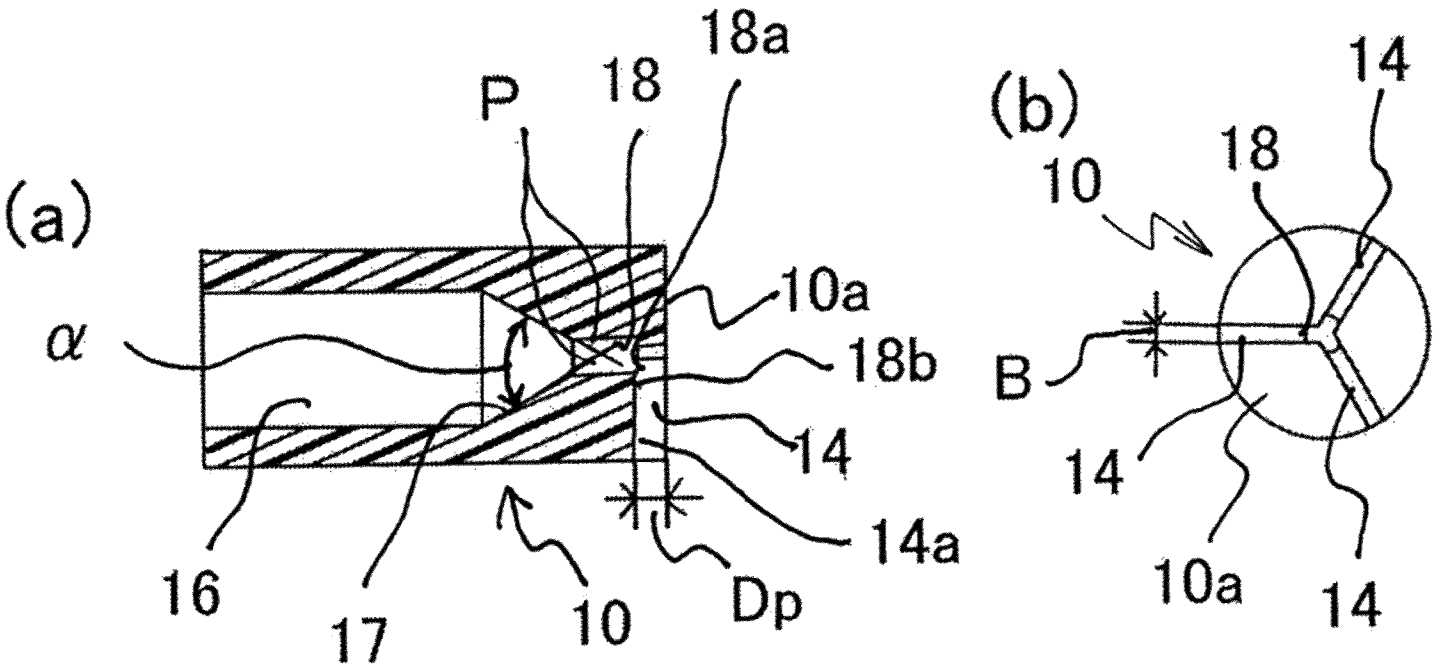
FIG. 3*a* and FIG. 3*b* are respectively a longitudinal cross sectional view and a front elevational view of the spray nozzle of FIG. 2.
Figure 4:
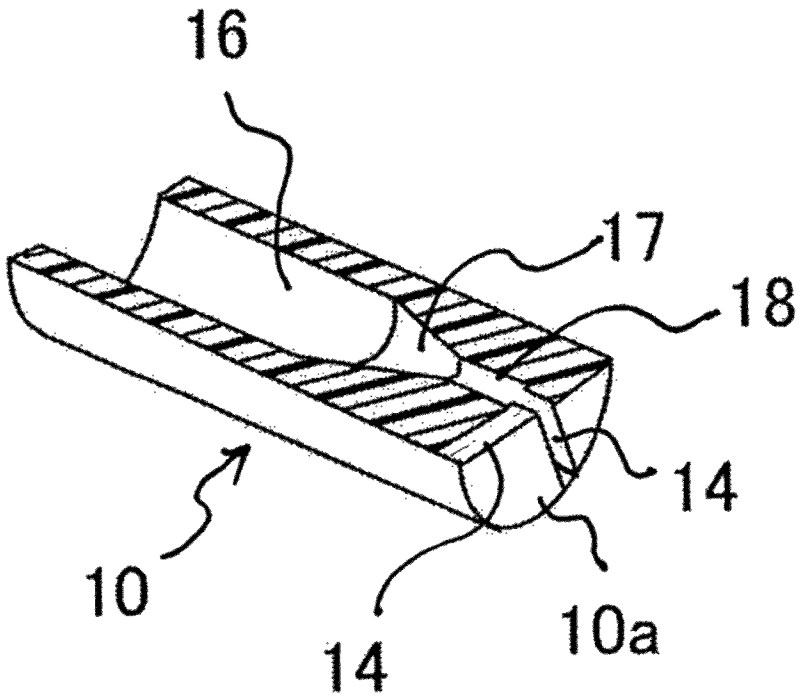
FIG. 4 is a partial cutout view of the spray nozzle of FIG. 2.
Figure 14:
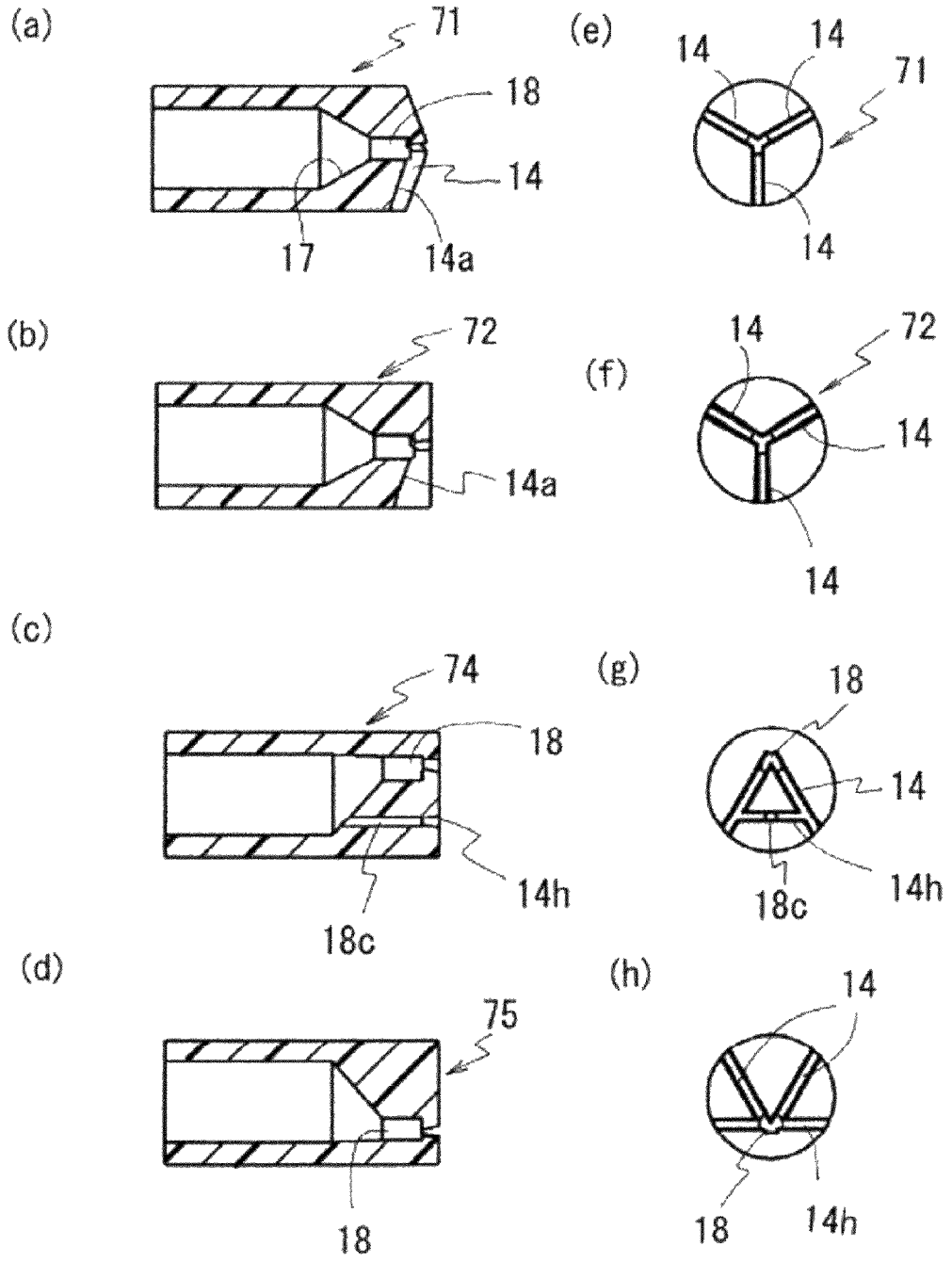
FIGS. 14*a-d* are respectively cross sectional views showing further the other embodiment of the spray nozzle of the present invention.
FIGS. 14*e-h* are respectively front elevational views of those spray nozzle.

A nozzle 71 shown in FIG. 14*a*, FIG. 14*b* is nearly same as the nozzle 10 shown in FIGS. 2-4, excepting that the front face is made to be a gradual sweepback angle. The taper angle of the front face is more gradual than the taper angle of the interior taper portion 17. In concert with the front face taper angle, the bottom face 14*a* of the slit passage 14 is made to back away at an identical angle. In this nozzle 71, since the momentum of spouting forward is diminished by the momentum of spouting forward, the contour becomes the spray pattern of a moderate circular arc or a parabola, when viewed from the side.

A nozzle 72 shown in FIG. 14*b* FIG. 14*f* is nearly same as the nozzle shown in FIGS. 2-4 excepting that the bottom face 14*a* of the slit passage 14 backs away toward outside. The configuration that the bottom face 14*a* of the slit passage 14 is made to back away toward outside is substantially identical with FIG. 8*a*, FIG. 8*c*. This nozzle is of an approximate Y-character shape, when viewed from the front, and of a moderate parabola, when viewed from the side.

A nozzle 74 of FIG. 14*c*, FIG. 14*g* is that in which a horizontal slit passage 14*h* which connects mutually the middle of two line segments constituting a V-character with regard to the slit passage 14 of a V-character shape of FIG. 65 of FIG. 12*d*, and a sub nozzle hole passage 18*c* opened at the center of the horizontal slit passage 14 are provided. The slit passage of the nozzle 74 viewed from the front expresses an approximate "A" character, it can spray with the spray pattern of A-character shape.

A nozzle 75 of FIG. 14*d*, FIG. 14*h* is that in which the horizontal slit passage 14*h* connected with the intersection portion of two line segments constituting a V-character shape with regard to the slit passage 14 of the V-character shape of the nozzle 65 of FIG. 12*d* is provided. The slit passage of this nozzle 75 viewed from the front expresses a "K" character shape, it can spray with the spray pattern of a K-character shape.

Figure 15:
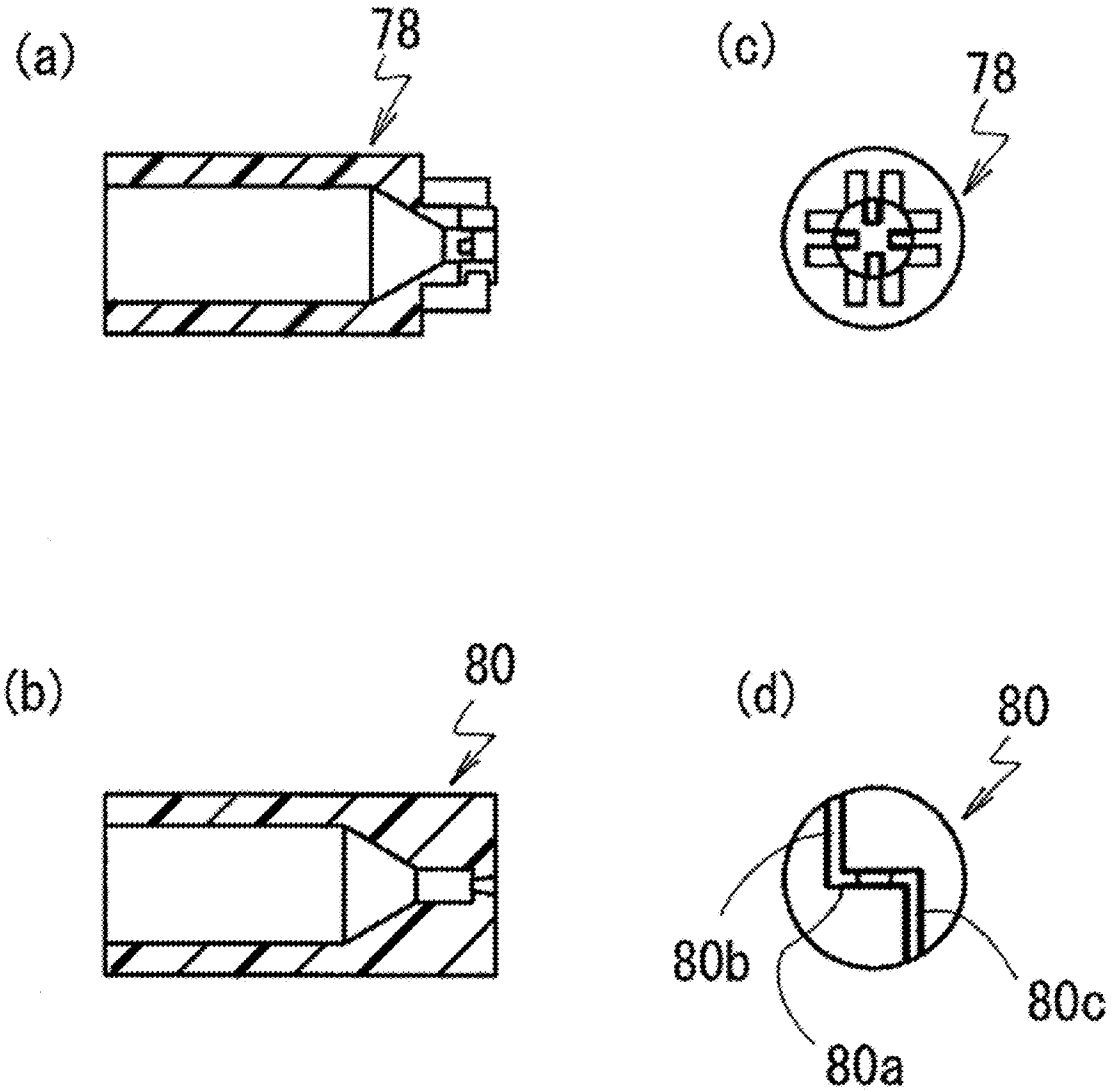
FIGS. 15*a-b* are respectively cross sectional views showing further the other embodiment of the spray nozzle of the present invention.
FIGS. 15*c-d* are respectively front elevational views of those spray nozzle.
Figure 19:
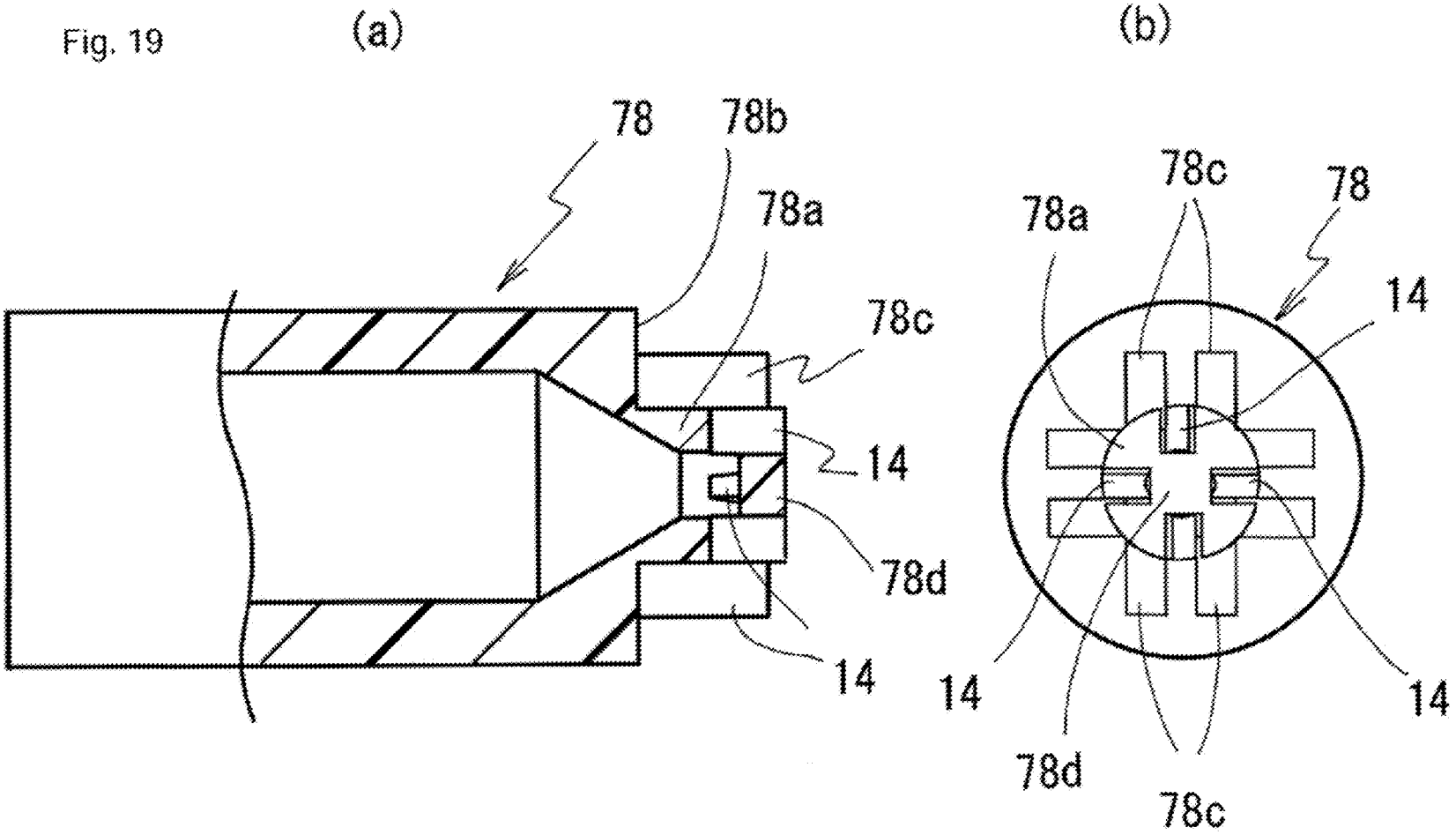
FIG. 19*a* and FIG. 19*b* are respectively enlarged views of FIG. 15*a* and FIG. 15*c;*

In s nozzle 78 shown in FIG. 15*a*, FIG. 15*c*, a cylindrical small diameter portion 78*a* is provided in a front end, a step portion 78*b* is formed in an outer periphery of somewhat back portion from the front end (refer to FIG. 19*a, b*). And, four pairs of passage walls 78*c* are stood up above and below, right and left from the outer periphery of the small diameter portion 78*a* over the step portion 78*b*. They can be two pairs, three pairs, or five pairs or more. The gap of those passage walls 78*c* are arranged radially. Further, in the small diameter portion 78*a*, the slit passage 14 connected with the gap of the passage wall 78*c* is engraved. The slit passage 14 does not reach the taper portion 17 and stops at the middle of the nozzle hole passage 18. The front end of the nozzle hole passage 18 is plugged by a plugging member 78*d*. With this nozzle 78, the spray pattern becomes an approximately cross shape when viewed from the front, but since it is spouted outside in the perimeter direction, while the front side spout is suppressed, the parabolic shape of the spray pattern of side view becomes further moderate. Further, since there is a space between the passage walls 78*c* mutually, when spouting from the slit passage 14, surrounding air of the nozzle 78 is easily engulfed, making the parabolic shape of the spray pattern becomes more moderate.

A nozzle 80 shown in FIG. 15*b*, FIG. 15*d* is formed into an approximate N-character shape consisting of a horizontal passage 80*a* whose slit passage is short, an upward passage 80*b* extending upwardly from the one end thereof, and a downward passage 80*c* extending downwardly from another end.

A nozzle 81 shown in FIG. 20*a*, FIG. 20*b* is nearly identical with the nozzle 80 of FIG. 19*a*, FIG. 19*b* in the point that the slit passage 14 extends radially in four directions, but it differs in the point that the end portion of the inside of radial direction comes to further inside than the inner perimeter surface of the nozzle hole passage 18. Stated differently, in the nozzle 80 of FIG. 19*a*, FIG. 19*b*, the end portion of inside of radial direction of the slit passage 14 is in a position nearly identical with the position of the inner face of the nozzle hole passage 16. Hence, the slit passage 14 and the nozzle hole passage 16 are opened outwardly in an approximately radial direction, and the opening thereof cannot be seen from the front. Hence, the forward spout is suppressed, and the spout is performed mainly radially.

Compared with this, in a nozzle 81 of FIG. 20*a*, FIG. 20*b*, the insection of the slit passage 14 enters into inside in a radial direction from the inner face of the nozzle hole passage 18. Hence, the slit passage 14 and the nozzle hole passage 16 are connected with outside not only by the outward opening 78*e* in a radial direction but also by the opening 78*f* facing the front side. In addition, a plugging member 78*d* of the front end of the nozzle hole passage 18 is smaller than the nozzle hole passage 16, but it is linked with a small diameter portion 78*a* at four places of corners. Since the spray pattern of the nozzle 81 extends not only to four directions of the outer peripheral direction, but spouts in the front side direction, the spray pattern becomes nearly the continuing shape of a cross.

Figure 20:
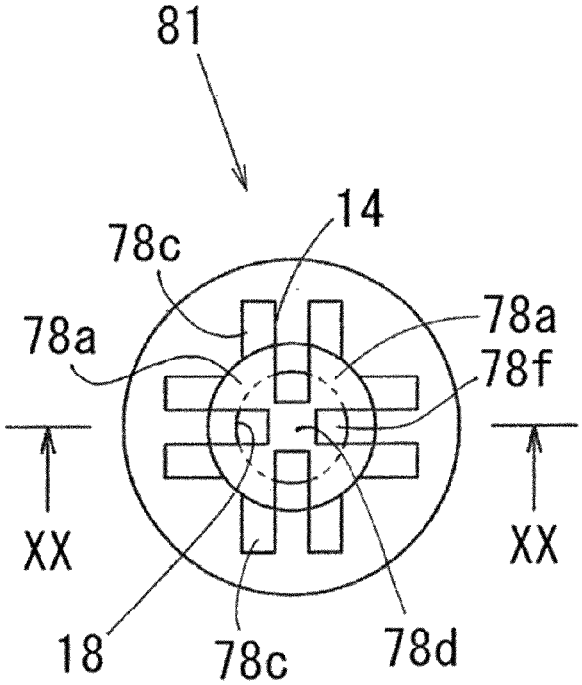
FIG. 20*a* and FIG. 20*b* are front elevational views showing further the other embodiment of the spray nozzle of the present invention and an XX-XX line cross sectional view thereof.
Figure 20:
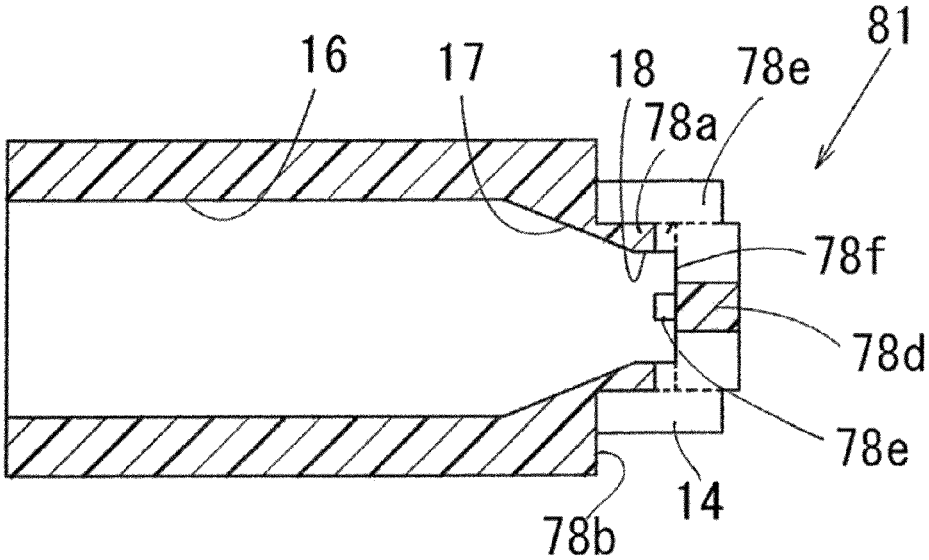
Figure 21:
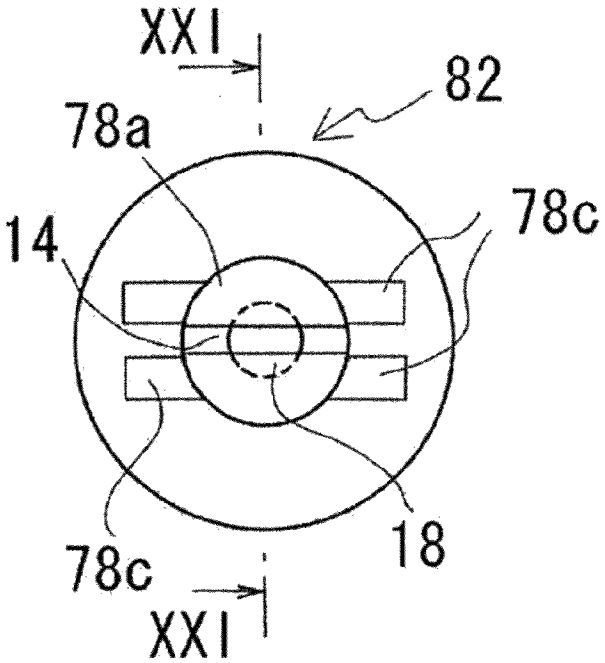
FIG. 21*a* and FIG. 21*b* are front elevational views showing further the other embodiment of the spray nozzle of the present invention and an XXI-XXI line cross sectional view thereof.
Figure 21:
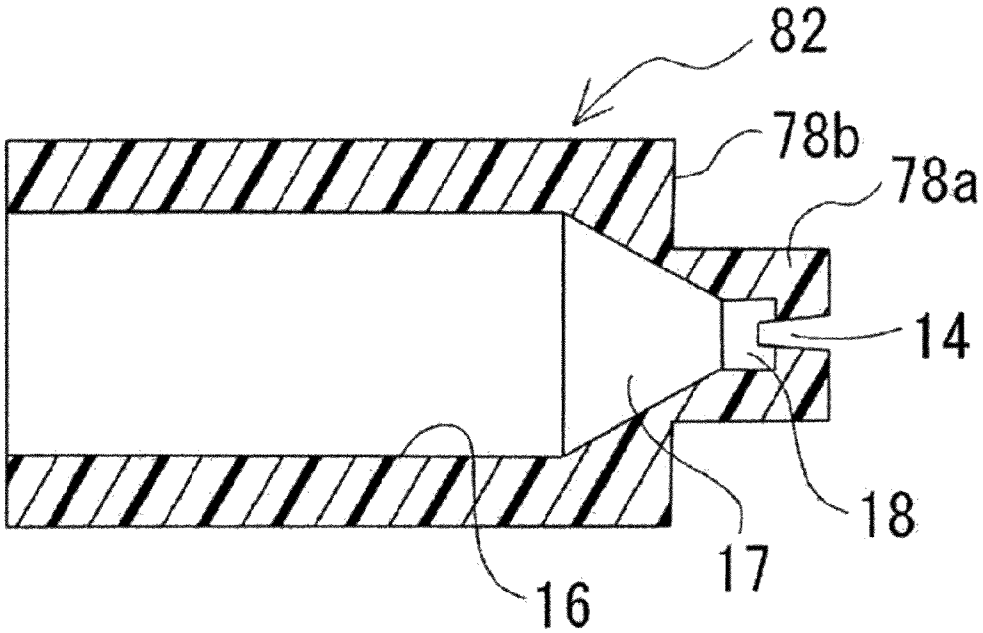

A nozzle 82 of FIG. 21*a*, FIG. 21*b* is nearly identical with the nozzle 81 of FIG. 20*a*, FIG. 20*b*, but the slit passage 14 extends only right and left, and is not provided with a slit extending in a vertical direction. Further, there is no plugging member (reference numeral 78*b* of FIG. 20) of the center of the front, the right and left being continued. Moreover, it is same as the nozzle 81 of FIG. 20 in the point that a cylindrical small diameter portion 78*a* is provided, that a step portion 78*b* is formed in the outer periphery of somewhat back portion from the front end, and that a passage 78*c* which forms an extended portion of the slit passage 14 from the outer periphery of the small diameter portion 78*a* over the step portion 78*b* is stood up. Two pairs of a passage wall 78*c* are provided right and left. The spray pattern F by this nozzle 81 is as thin as that of FIG. 23 viewed from the side, and expresses the shape of an approximate parabola viewed from the above as FIG. 1*b*, and is flat viewed from the front (refer to FIG. 6*c*, FIG. 7*c*).

Figure 22:
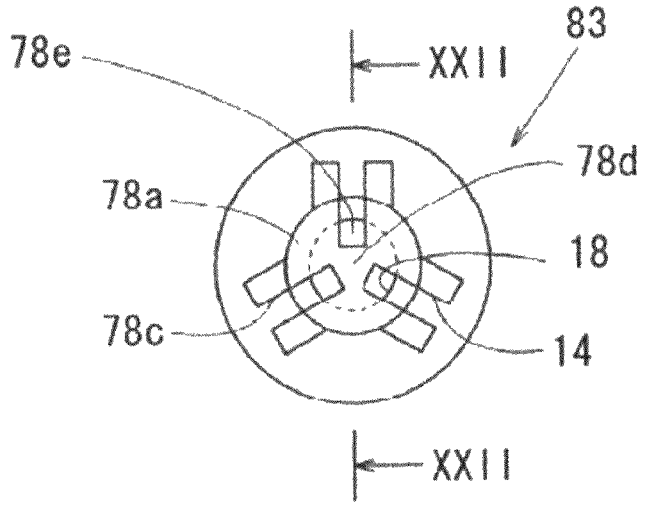
FIG. 22*a* and FIG. 22*b* are front elevational views showing further the other embodiment of the spray nozzle of the present invention and an XXII-XXII line cross sectional view thereof.
FIG. 22*c* is a cross sectional view showing further the other embodiment of the present invention.
Figure 22:
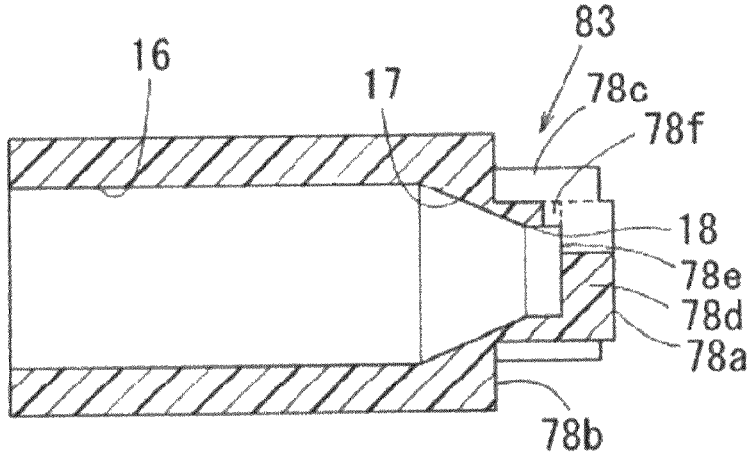
Figure 22:
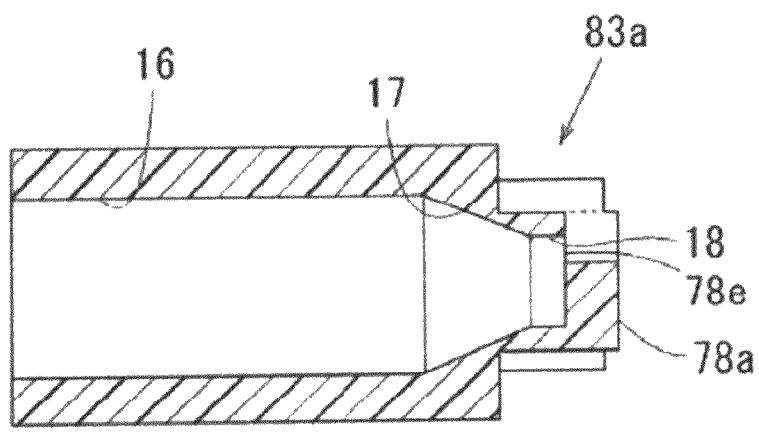

A nozzle 83 of FIG. 22*a*, FIG. 22*b* is substantially identical with the nozzle 81 of FIGS. 20*a, b*, excepting the point that the slit passage 14 is extending radially in three directions, and the point that three pairs of the passage wall 78*c* forming the extended portion of those slit passages are provided radially at a 120 degrees interval. Moreover, it is substantially identical with the nozzle 36 of FIG. 6*a*, FIG. 6*b* and the nozzle 38 of FIG. 7*a*, FIG. 7*b*, excepting the point that the thickness of the slit passage 14 is rather thinner than the diameter of the cylindrical column like nozzle passage 18. In addition, since in the nozzle 83*b* of FIG. 22*b*, the slit passage 14 cuts into the small diameter portion 78*a* deeper than the thickness of the plugging member 78*d* in an axial direction, there is a portion where opened outwardly in a radial direction (refer to reference numeral 78*f*), but as FIG. 22*c*, the slit passage 14 may be made so as to cut in as thick as the thickness of the plugging member 78*d*. In that case, it is opened only in the front side (refer to reference numeral 78*e*), being not opened outwardly in a radial direction. Hence the front view is same as FIG. 22*a*. In addition, in the nozzle 81 also in which four slit passages of FIG. 20*a*, FIG. 20*b* are provided radially, it can also be made to be opened only in the front direction, being not opened outwardly in a radial direction.

Figure 23:
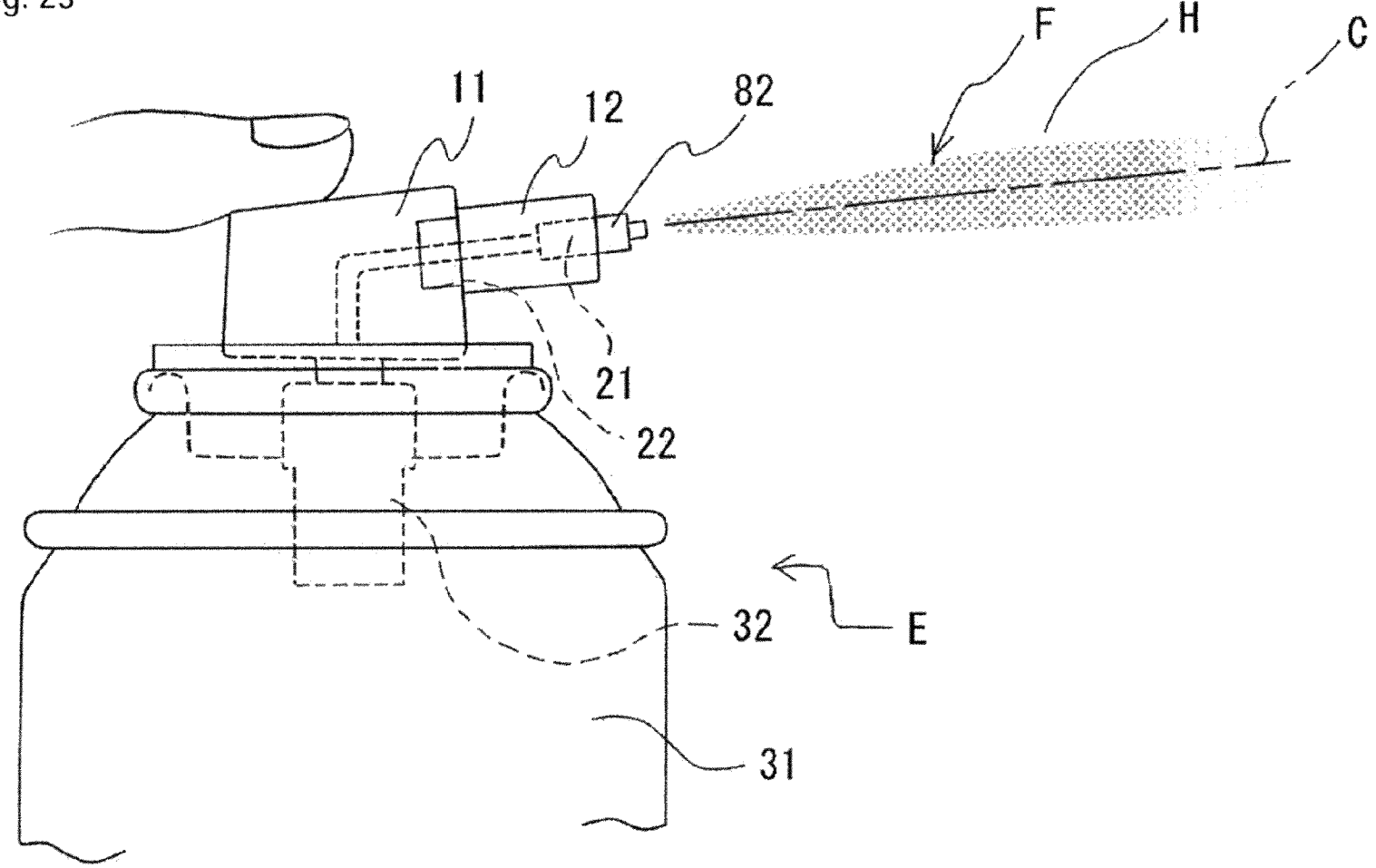
FIG. 23 is a side view showing further the other embodiment of the aerosol product of the present invention.

FIG. 23 shows an aerosol product E2 equipped with the nozzle 82 of FIG. 21*a*, FIG. 21*b*. This nozzle 82 is attached to the valve in the state that the slit passage 14 of laterally straight line faces nearly a horizontal direction. In this product, when the push button 11 is pushed, spraying is performed in the spray pattern F (refer to FIG. 6*c*, FIG. 7*c*)

which expands in a lateral direction and do not expand in a vertical direction. The other points, particularly that the shape H of the spray pattern draws a semi parabola etc. is same as the nozzle 10 of FIG. 1.

Figure 24:
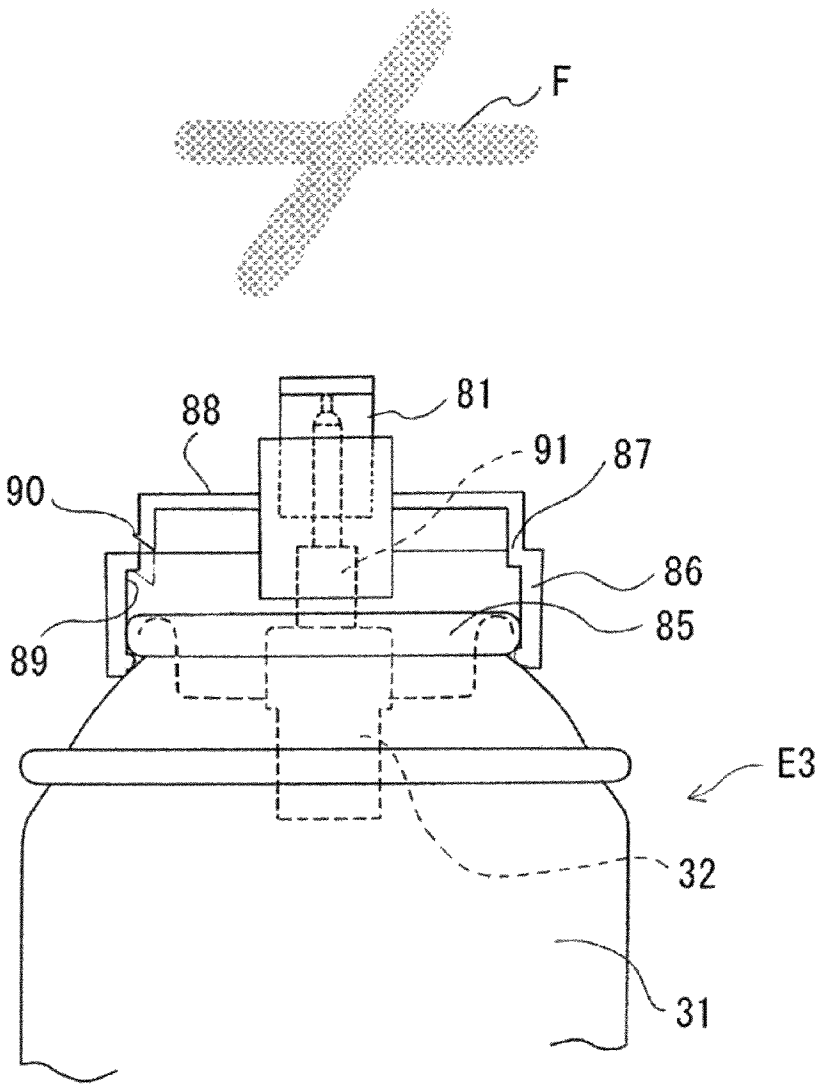
FIG. 24 is a side view showing further the other embodiment of the aerosol product of the present invention.

FIG. 24 shows an embodiment of an aerosol product of full volume spraying type. In the aerosol product E3, an approximately cylindrical shape holding member (shoulder cover) 86 is attached to a covered portion 85 of a mounting cup 84 firmly attached to the upper end of a container body 31. The holding member 86 is equipped with an operation piece 88 connected by a hinge (resin hinge etc.) 87, in the front end of the operation piece, an engagingly stopping protrusion 90 freely engageable and disengageable with the engagingly stopping step portion 89 provided in the inside surface of the holding member 86 is provided. In the intermediate portion of the operation piece 88, a nozzle holding portion 92 of which the lower portion is attached to the perimeter of a stem 91, and to the upper end of which the nozzle is attached is provided. The nozzle 81 is the nozzle 81 shown in FIG. 20, and is equipped with the slit passage 14 of an approximate cross shape.

When the operation piece 88 is pushed in, this can spray a content upward in the spray pattern F of an approximate cross shape. Furthermore, since the engagingly stopping protrusion 90 engages with the engagingly stopping step portion 89, if a finger pushing the operation piece 86 is taken off, the stem 89 is kept pushing. Hence, all amount of the content can be sprayed. As the content, an insecticide of fumigation type etc. can be cited. Since the planar shape of the spray pattern F thereof is an approximate cross shape, when sprayed in a rectangular parallelepiped room, if the cross shape is arranged so as to be adapted to the corner of the room, it is possible to spray the content efficiently to the corner of the room where harmful insects are easy to come into being, particularly to the corner of a ceiling.

Figure 25:
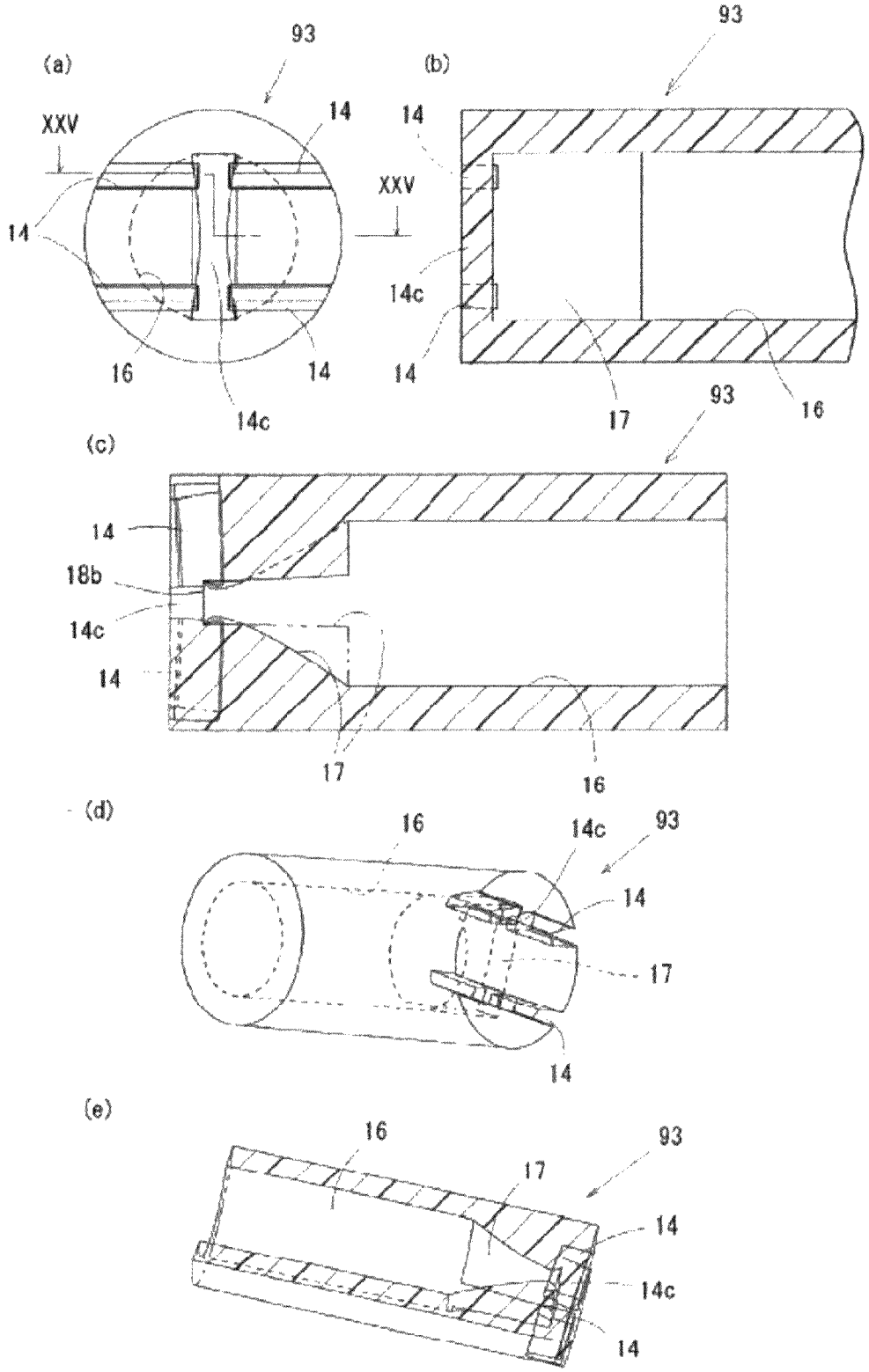
FIG. 25*a*, FIG. 25*b*, FIG. 25*c*, FIG. 25*d*, and FIG. 25*e* are respectively a front elevational view, a longitudinal cross sectional view, an XXV-XXV line horizontal cross sectional view of FIG. 25*a*, a perspective view, and a halved perspective view.

A nozzle 93 of FIG. 25*a*, FIG. 25*b* is, same as the case of the nozzle 36 of FIG. 6, that in which two slit passages 14 are provided so as to be nearly in parallel mutually. Each slit passage 14 is interrupted by the plugging member 14*c* at a central portion. In addition, in FIG. 25*a*, they are made to be horizontal slits separated vertically, but if the angle is changed, they become longitudinal slits separated right and left. The gap between the slit passages 14 is mutually about 1-10 mm. And, in the taper portion 17 continuing the circular column like passage 16, as shown in FIG. 25*c*, the width of right and left becomes narrow toward the front end viewed from the horizontal direction, but as shown in FIG. 25*b*, since they are connected to the upper and lower slits 14 viewed from side, they do not become narrow toward the front end, and extend nearly rectangular (refer to FIG. 25*d*, FIG. 25*e*).

Moreover, as found from the upper side (cross section along the slit 14) of FIG. 25*a* and FIG. 25*c*, the inner face of the taper portion 17 is made to be narrow in the vicinity of the upper end or the lower end, and as found from the lower side (horizontal cross section along the center) of FIG. 25*c*, it is made to be taper like in the central portion of a vertical direction. Accordingly, in this embodiment, the taper portion 17 functions as a longitudinal slit connecting the upper and the lower slit passage 14. Further, the slit passage 14 and the taper portion 17 are connected by an opening 18*b*, the nozzle hole passage 18 extending in the shape of nearly identical cross section such as nozzle 36 of FIG. 6 is not equipped.

If being sprayed by the nozzle 93 constituted as above, the spray pattern is two planer or plate like patterns immediately after going out of the slit passage 14, and is of the shape of approximately "II" in Roman numeral in the front view. However, the both patterns gradually come close mutually, and are integrated to be one planer or plate like pattern. This is assumed that the both attract each other because the static pressure becomes low in a spray moving at a high speed. And in the integrated pattern, the spray pattern becomes a planer spray pattern equipped with an expansion of same extent or more as the spray pattern of a lateral straight line shown in FIG. 6. Moreover, the plugging member 14*c* plugging the central portion of the slit passage 14 prevents the spray going out of the taper portion 17 from going out straight forward. Thereby, the spray pattern tends to expand further outwardly. That which is not provide with the nozzle hole passage extending straight forward contributes also to forming of the spray pattern expanding outwardly.

Figure 26:
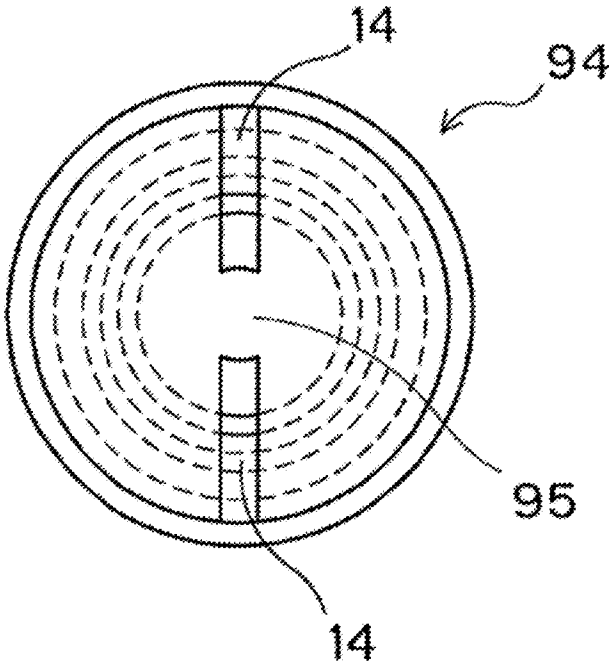
FIG. 26*a* and FIG. 26*b* are respectively a front elevational view and a longitudinal cross sectional view showing further the other embodiment of the spray nozzle of the present invention.
Figure 26:
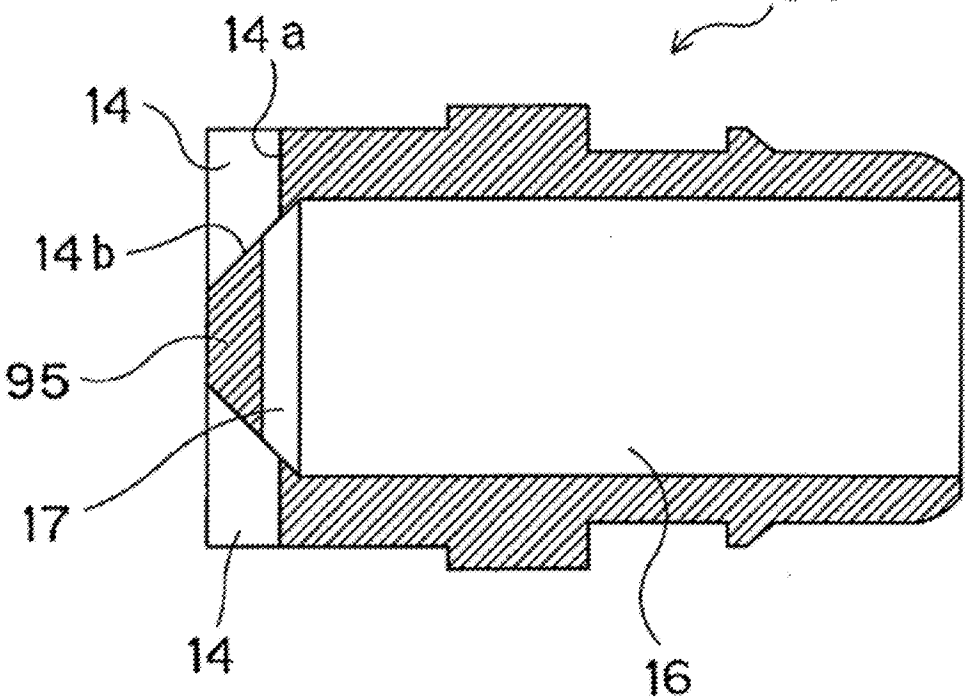

In a nozzle 94 shown in FIG. 26*a*, FIG. 26*b*, the taper portion 17 continuing the front end of the cylindrical passage 16 is short, the front side of which is plugged by a plugging member 95. And, one pair of upper and lower slits 14, 14 is provided from the front face over the outer peripheral surface. A bottom face 14*a* of the back end side of the axial direction of the slit 14 is perpendicular to the axis of the nozzle 94, but an inner bottom face 14*b* of the inside of radial direction becomes a gradient plane identical with or continuing with the inner face of the taper portion 17. And, it is connected with the inner cavity of the taper portion 17 in the upper portion of the inner bottom face 14*b*.

If being sprayed by the nozzle 94 of FIG. 26*a*, FIG. 26*b*, in the vicinity of the outlet, the spray pattern is separated, but it becomes integrated soon, and a thin plate like pattern is obtained. And, since the air flow proceeding forward straightly from the vicinity of the central portion is disturbed by the plugging member 95, the density of the central portion does not become high, a spray pattern of which the density of the central portion and the peripheral portion is nearly uniform is formed. Further, since the inner bottom face 14*b* of the slit 14 is made to be a gradient plane facing the center toward the front end, the spray spouted from the slit is easy to proceed to the central side. In addition, the direction of the slits 14, 14 can be selected when in designing or when in attaching, such that it is not limited to be arranged vertically, but to be arranged right and left.

Figure 27:
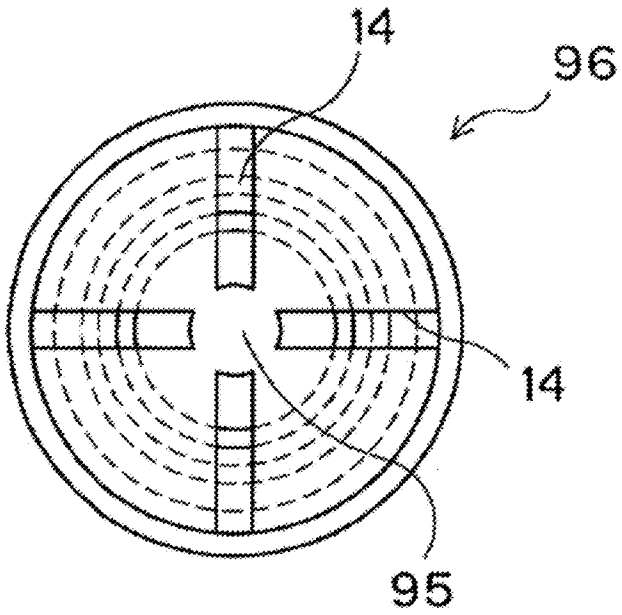
FIG. 27*a* and FIG. 27*b* are respectively a front elevational view and a longitudinal cross sectional view showing further the other embodiment of the spray nozzle of the present invention.
Figure 27:
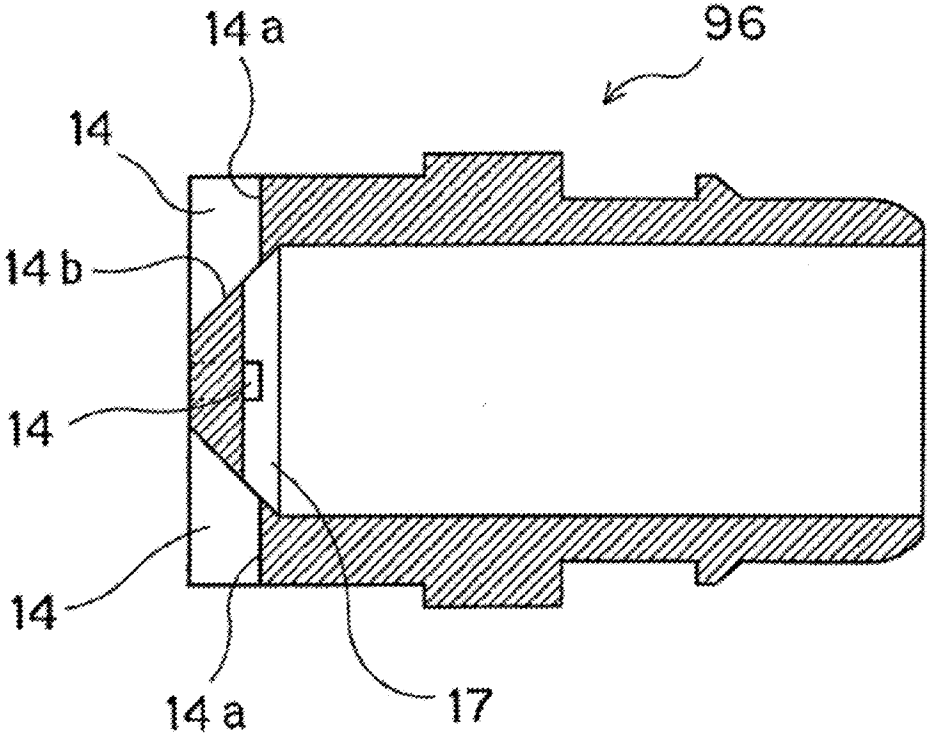

A nozzle 96 shown in FIG. 27*a*, 27*b* is made to be arranged so that one pair of right and left slits 14, 14 are further added to the nozzle 94 shown in FIG. 26*a*, FIG. 26*b*, four slits 14 as a whole are radially arranged at an equal interval, in other words, being configured to be a cross shape. If being sprayed by this nozzle 96, the pattern is separated above and below, right and left in the vicinity of the outlet, but it soon becomes integrated, obtaining a thin plate like of which the cross section is of a cross shape. In this also, it is possible to avoid the density becoming particularly dense in the center.

Figure 28:
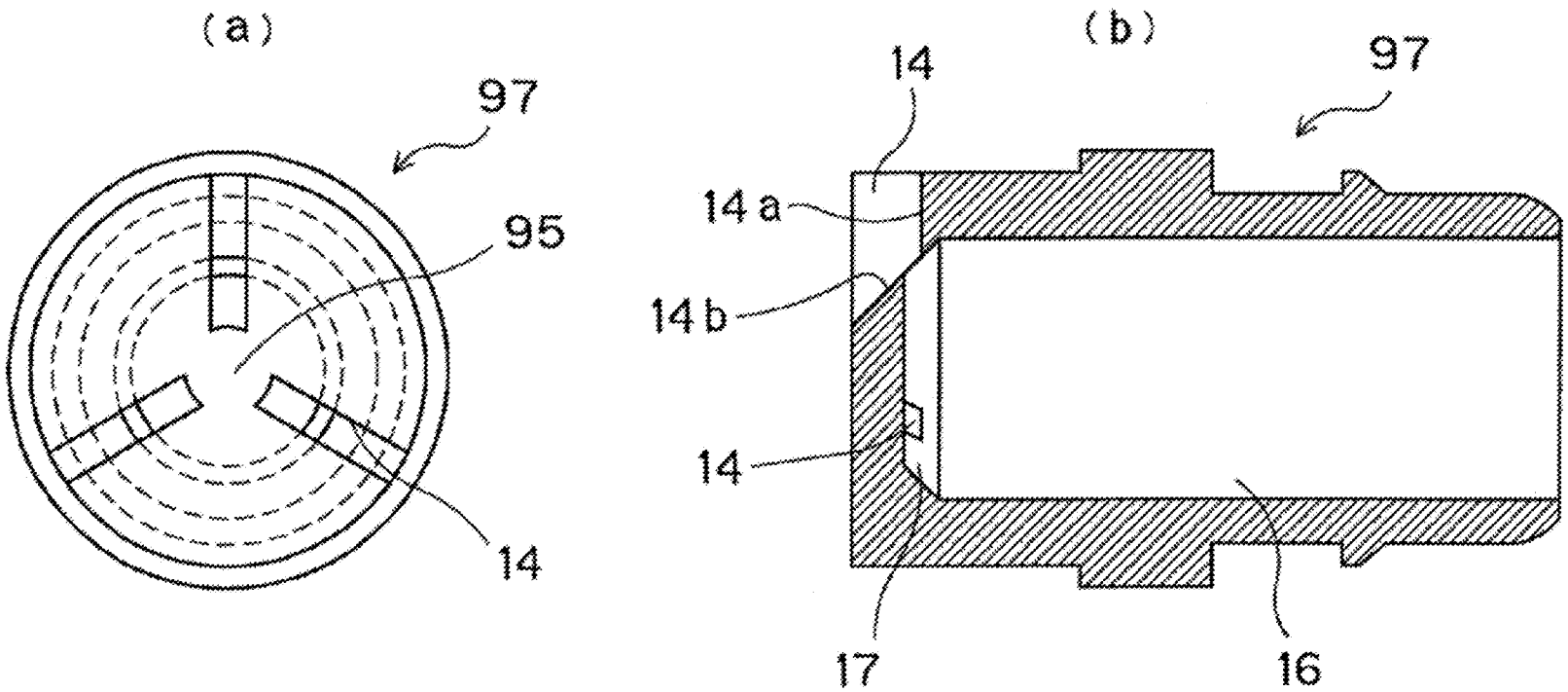
FIG. 28*a* and FIG. 28*b* are respectively a front elevational view and a longitudinal cross sectional view showing further the other embodiment of the spray nozzle of the present invention.

A nozzle 97 shown in FIG. 28*a*, FIG. 28*b* is substantially identical with the nozzles 94, 96 shown in FIG. 26*a*, FIG. 27*a* excepting that the three slits 14 are provided radially at an equal interval. By this nozzle, a spray pattern of thin plate like of which the cross section is a Y-character shape can be obtained. In this also, it is possible to avoid the density becoming particularly dense in the center.

Figure 29:
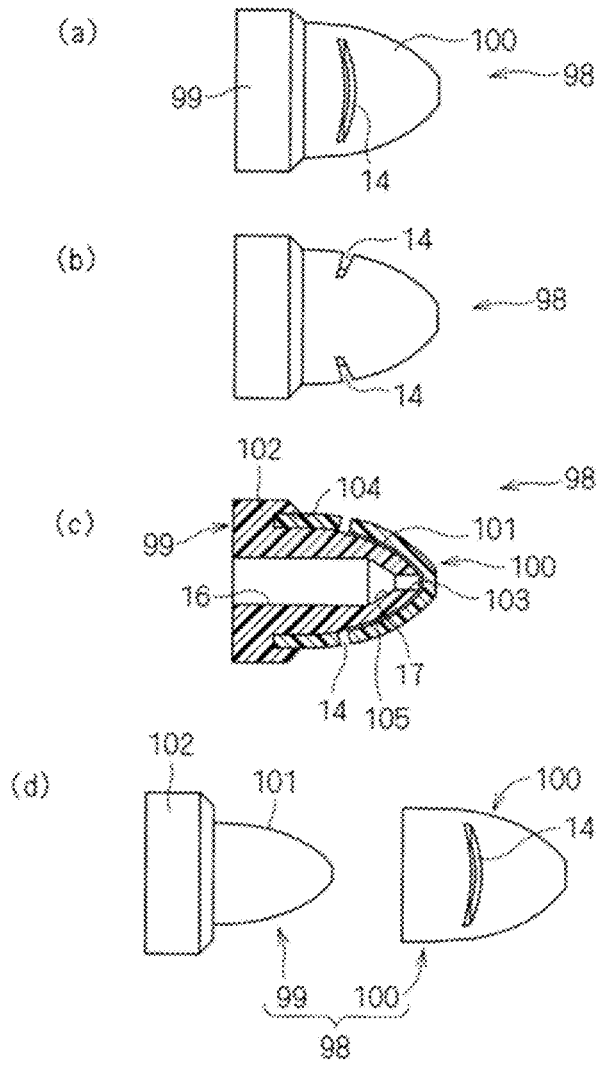
FIG. 29*a*, FIG. 29*b*, FIG. 29*c*, and FIG. 29*d* are respectively a plain view, a side view, a cross sectional view, and a plain view before assembling showing further the other embodiment of the spray nozzle of the present invention.

A nozzle 98 shown in FIG. 29*a*, FIG. 29*b* consists of, as shown in FIG. 29*c*, FIG. 29*d*, two parts of an inner nozzle 99 and an outer nozzle 100 fitted to the outer periphery of the inner nozzle 99. The inner nozzle 99 is equipped with an external surface 101 which curves like a bombshell and a flange 102 provided in the back end outer periphery. And in the center thereof, a passage 16 to make a content pass through and the taper portion 17 same as FIG. 2*a* etc. are formed. A squeezing passage 103 is penetrated in the front end thereof. The squeezing passage 103 is a through hole nearly same as the nozzle hole passage 18 of FIG. 3 etc. In the front face of the flange 102, an annular fitting groove 104 is formed.

The outer nozzle 100 has a cap like shape covered through the spray passage 105 of a slim gap on the perimeter of the external surface 101 of the inner nozzle 99, the back end of which is fitted to the fitting groove 104 of the flange 101 so as not to come off. And in the intermediate portion of the front end and the back end of the outer nozzle 100, one pair of the approximately circular arc shaped slit passages 14 as shown in FIG. 29*a*, FIG. 29*b* is formed so as to connect inside and outside. The slit passage 14 is facing outward radially to the center of the nozzle, and is inclined to the front side slightly. The front end of the outer nozzle 100 is plugged. However, various shape slit passages can be adopted as far as there is no problem in the strength and the retaining of the outer nozzle 100.

In this nozzle 98, after assembling, a spraying passage 105 consisting of the gap of the both sides between the external surface 101 of the inner nozzle 99 and the internal surface of the outer nozzle 100 is formed as shown in FIG. 29*c*. The gap is, for example, about 0.1-2 mm, when the width is larger than that, the flow velocity becomes low, resulting in a small spray pattern, and when the width is narrower than that, the amount of spray is suppressed, resulting in a small spray pattern. In the backward than the slit passage 14, the spray passage 105 may be not necessary to be provided, the outer nozzle 100 may be firmly contacted to the external surface 101 of the inner nozzle 99. In this nozzle 98, the content supplied from the center passage 16 spouts from the squeezing passage 103 of the front end of the inner nozzle 99, and passes through the spray passage 105 between the external surface 101 of the inner nozzle 99 and the internal surface of the outer nozzle 100, and is sprayed outside from the slit passage 14. Since the spray passage 105 is smooth, it does not almost disturb the passage of the content. In this nozzle 98, by flowing the content in a direction in reverse to the direction toward outside with the spray passage 105, it is possible to spray softly to outside. The spray pattern spouted from each spray passage 14 does not influence each other. Accordingly, as is the case of the nozzle 93 of FIGS. 25*a-e*, the spray patterns do not gradually come close to become one sheet of the spray pattern. And, in this embodiment, two sheets of plate like spray pattern of the shape of "II" of Roman numeral of which the number is same as the number of the slit passage 14 can be obtained. The number of the slit passage 14 may be three or four or more.

Instead of providing the spray passage 105 in the whole of the external surface 101, about one to six groove like spray passages may be formed in the external surface 101 of the inner nozzle 98 or the inner surface of the outer nozzle 100. However, when the whole or the large part of the gap of the external surface 101 and the internal surface is made to be the spray passage 105, since there is no limit in the shape of the slit passage 14, there is a merit that the outer nozzle equipped with a slit passage 14 of which the shape is different variously according to usage can be selected to spray by a desired pattern. Since this nozzle consisting of two parts can be manufactured by every part, it is easy to manufacture. Particularly when it is made to be a molded part of resin, the die of injection molding becomes simple. Moreover when the outer nozzle 100 is made to be freely detachable and attachable, it is possible to change the size of the gap of the spray passage and the shape of the slit passage 14 by only replacing the outer nozzle 100. Further, even if a narrow spray passage is clogged up by a foreign material when in use, the foreign material can be easily cleared away.

Figure 30:
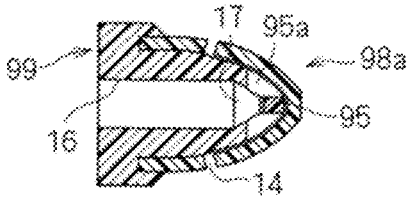
FIG. 30 is a cross sectional view showing further the other embodiment of the spray nozzle of the present invention.

In a nozzle 98*a* shown in FIG. 30, the squeezing passage (reference numeral 103 of FIG. 29*c*) is not provided in the front end of the inner nozzle 99, while the front end of the taper portion 17 is plugged with a plugging member 95, a slit like passage 95*a* reaching the surface from the taper portion 17 so as to surround the plugging member 95 is formed. The other configurations are same as the nozzle 98 of FIGS. 29*a-d* in the point that the spray passage consisting of a narrow curved plane shaped gap of fitting portion of the inner nozzle 99 and the outer nozzle 100 is formed, and that the slit passage 14 is formed in the outer nozzle 100, In the aerosol product using this nozzle 98*a*, a content supplied to the passage 16 of the center of the nozzle enters the taper portion 17, further, expands outwardly radially from the slit like passage 95*a*, turns around, passes through the gap of the inner nozzle 99 and the outer nozzle 100, and is sprayed outside from the slit passage 14.

In addition, the number of the slit like passage 95*a* of the inner nozzle 99 and the number of the slit passage 14 of the outer nozzle 100 may by three or more, such as 3-8. In this case, if the number of the slit passage 14 is adapted to that of the slit like passage 95*a*, the flow becomes smooth. However, the both sides may be different. The slit like passage 95*a* can be regarded as a part of the spray passage.

Figure 31:
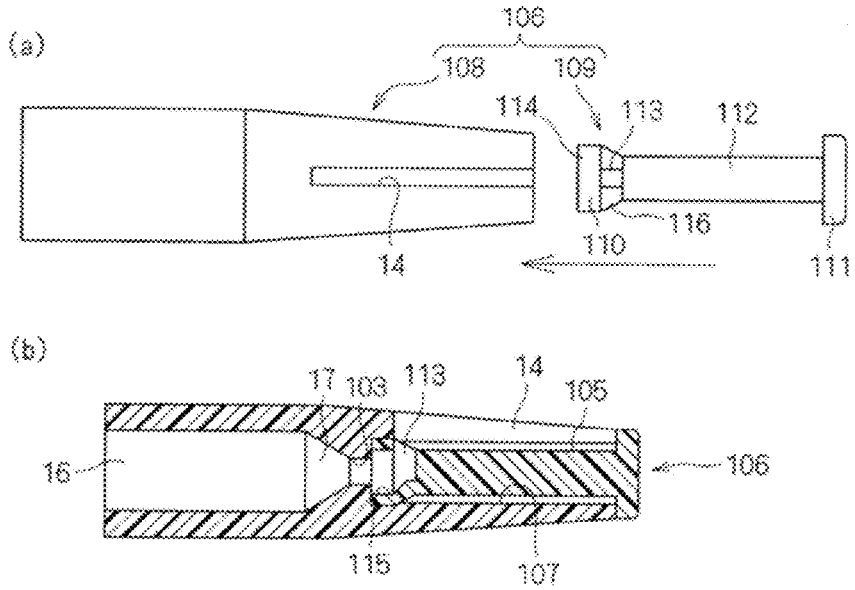
FIG. 31*a* and FIG. 31*b* are respectively a plain view before assembling and a cross sectional view after assembling showing further the other embodiment of the spray nozzle of the present invention.

A nozzle 106 shown in FIG. 31*a*, FIG. 31*b* consists of two parts of a nozzle body 108 equipped with a circular column like empty space 107 in the front end, and an outer nozzle 109 fitted in the empty space 107, those gaps forming a spray passage 105. The nozzle body 108 has, as shown in FIG. 31*b*, the passage 16, the taper portion 17 and a squeezing passage 103, in the front end side of which, the three slit passages 14 connecting the empty space 107 and outside is provided radially at an equal interval. It may be two or four or more.

The outer nozzle 109 is equipped with a base portion 110 fitted and fixed to the vicinity of the inner bottom of the empty space 107 of the nozzle body 108, a plugging portion 111 plugging the front end opening of the empty space 107 by contacting the front end of the nozzle body 108, and a circular column portion 112 between them. The outer diameter of the circular column portion 112 is somewhat smaller than the inner diameter of the empty space 107, the spray passage 105 consisting of the cylindrical gap between the both is formed when assembled. In the base portion 110, an introducing hole 113 which connects the squeezing passage 103 and the spray passage 105 is formed.

In this nozzle 106, a circular column like concave portion 115 of which the diameter is larger than the squeezing passage 103 is formed in the lower face (left side of FIG. 31*b*) 114 of the base portion 110, the above described introducing hole 113 is formed so as to connect the concave portion 115 and the upper surface (right side of FIG. 31*b*) 116 of the base portion 110. In this embodiment, the upper surface 116 of the base portion 110 and the inner bottom face of the concave portion 115 is made to be taper like respectively, the introducing hole 113 is made to be of the configuration of cutout formed in the upper surface 116. The number of the introducing hole 113 may be one or may be the same number as the slit passage 14.

In this nozzle 106, the content passed through the squeezing passage 103 of the nozzle body 108 enters the doughnut like spray passage 105 from the introducing hole 113 of the outer nozzle 109, and is sprayed radially from the spray passage 14 of the side face of the nozzle body 108. In addition, when the number of the introducing hole 113 is made to be the same number as the slit passage 14, and the both sides are assembled so as to be suited to each other, it is not necessary to provide a gap between the inner surface of the empty space 107 and the outer surface of a circular column portion 112.

However, by making almost whole of the cylindrical gap as the nozzle passage 105, there is a merit that it can spray like a tornado form, since the content flows to the front end side, while whirling round in the spray passage 105. Moreover, by making it to be two parts, manufacturing thereof becomes easy. When making the outer nozzle 109 to be freely detachable and attachable, there is a merit that such as the size of the gap of the spray passage 105 can be changed easily.

Figure 32:
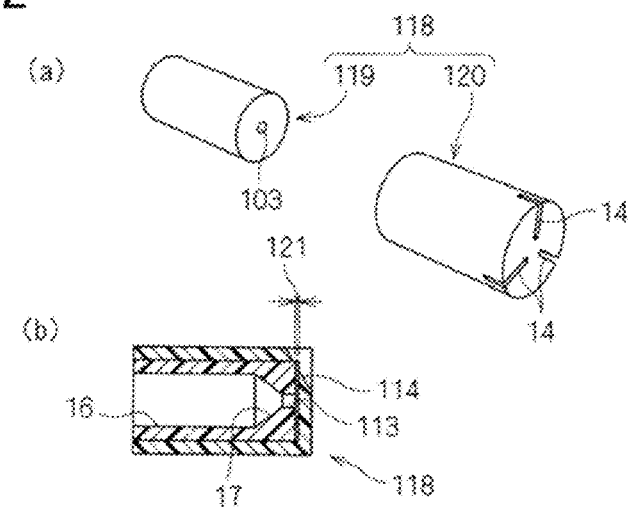
FIG. 32*a* and FIG. 32*b* are respectively a perspective view before assembling and a cross sectional view after assembling showing further the other embodiment of the spray nozzle of the present invention.

A nozzle 118 shown in FIG. 32*a*, FIG. 32*b* consists of a circular column like inner nozzle 119 and a bottomed cylinder like outer nozzle 120 covered on the outer periphery thereof. The front end surface of the inner nozzle 119 is not closely attached to the inner bottom face of the outer nozzle 120, and a gap 121 serving as the spray passage is provided. Thus, the spray passage is made to be approximately perpendicular to the center line of the nozzle, and to be of the shape of various configuration, provided that it is a thin gap of mutual surface, other than the surface curving like a bombshell as the nozzle 98 of FIG. 29, and the cylindrical surface which is centered at the center line of the nozzle such as the nozzle 106 of FIG. 31. Further, the spray passage made up of narrow planar gap and the groove like or slit like spray passage may be combined.

In the inner nozzle 119, the passage 16, the taper portion 17, and the squeezing passage 103 are formed. And in the vicinity of the front face of the outer nozzle 120, the slit passage 14 connecting the interior portion and the exterior portion is formed. In this embodiment, the slit passage 14 is, as shown in FIG. 31*a*, provided in three places radially excepting the center. Moreover, the bottom face of the slit passage 14 is, as shown in FIG. 31*b*, inclined toward the front end facing the center side. However, it may be rectangular, equipped with bottom faces in parallel and perpendicular to the axis, being not inclined as FIG. 22*b*, FIG. 22*c* etc. In this nozzle 118, the content going out of the squeezing passage 103 passes through a gap 121, and expands outwardly, spouts from the slit passage 14.

Figure 33:
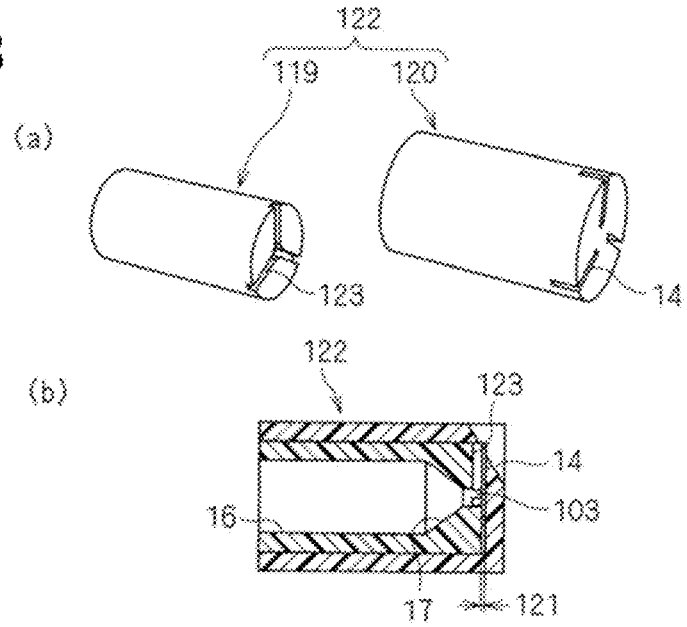
FIG. 33*a* and FIG. 33*b* are respectively a perspective view before assembling and a cross sectional view after assembling showing further the other embodiment of the spray nozzle of the present invention.

This nozzle 118 can obtain a spray pattern same as that of the nozzle 83 of FIGS. 22*a-c*, since the direction of the content is changed 90 degrees by colliding against the inner bottom face of the outer nozzle 120, and reaches the slit passage 14 passing through the gap 121. Moreover, since it is of two parts, the manufacture is easy. Further, if the outer nozzle 120 is made to be freely detachable and attachable, by replacing the outer nozzle 120, the slit passage of various configurations can be obtained making it possible to change the spray pattern according thereto, A nozzle 122 shown in FIG. 33*a*, FIG. 33*b* is same as the nozzle 118 shown in FIG. 32*a*, FIG. 32*b*, excepting that three slit grooves 123 reaching the outer peripheral surface from the squeezing passage 103 are radially formed in the front face of the inner nozzle 119. As the outer nozzle 120, the outer nozzle 120 of FIG. 32*a*, FIG. 32*b* can be used. The slit groove 123 of the inner nozzle 119 is assembled so as to be shifted slightly around the center axis with regard to the slit passage 14 of the outer nozzle 120, but it is assembled so as to be connected. The front face of the inner nozzle 119 may be closely contacted with the inner bottom face of the outer nozzle 120. In this nozzle 122, the content going out from the squeezing passage 103 proceeds outwardly along the slit groove 123, the direction of which is changed obliquely by colliding with the wall of the outer nozzle 120 and is spouted outside from the slit passage 14. This nozzle 122 also has a merit same as the nozzle 116 of FIG. 32*a*, FIG. 32*b*, further, since it can spray in an oblique direction, the spray pattern becomes a tornado shape. The tornado condition can be adjusted by making the outer nozzle 120 rotatable to the inner nozzle 119.

Figure 34:
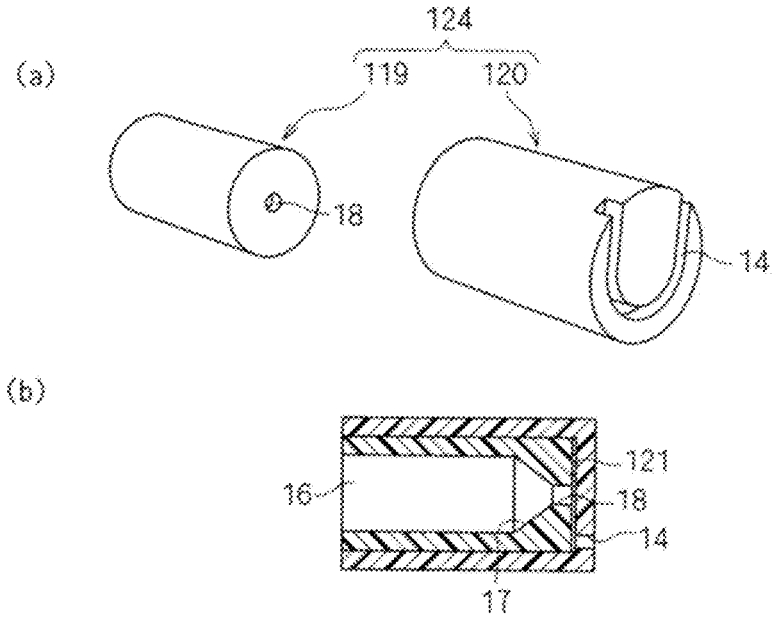
FIG. 34*a* and FIG. 34*b* are respectively a perspective view before assembling and a cross sectional view after assembling showing further the other embodiment of the spray nozzle of the present invention.

A nozzle 124 shown in FIG. 34*a*, FIG. 34*b* is same as the nozzle 118 of FIG. 32*a*, FIG. 32*b* excepting that the shape of the slit passage 14 of the outer nozzle 120 is made to be U-character like same as the nozzle 61 of FIG. 16*b*. In this nozzle 124, between the squeezing passage 103 and the slit passage 14 is connected by a gap 121 expanding planarly. Hence most of the portion of the U-character shaped slit passage 14 is connected with the gap 121. Further, the front face of the squeezing passage 103 is plugged. Hence, a uniform U-character shaped spray pattern compared with the nozzle 61 of FIG. 16*a*, FIG. 16*b* can be obtained. The inner nozzle 119 can be in common use with the inner nozzle 119 of the nozzle 118 of FIG. 32*a*, FIG. 32*b*.

Figure 35:
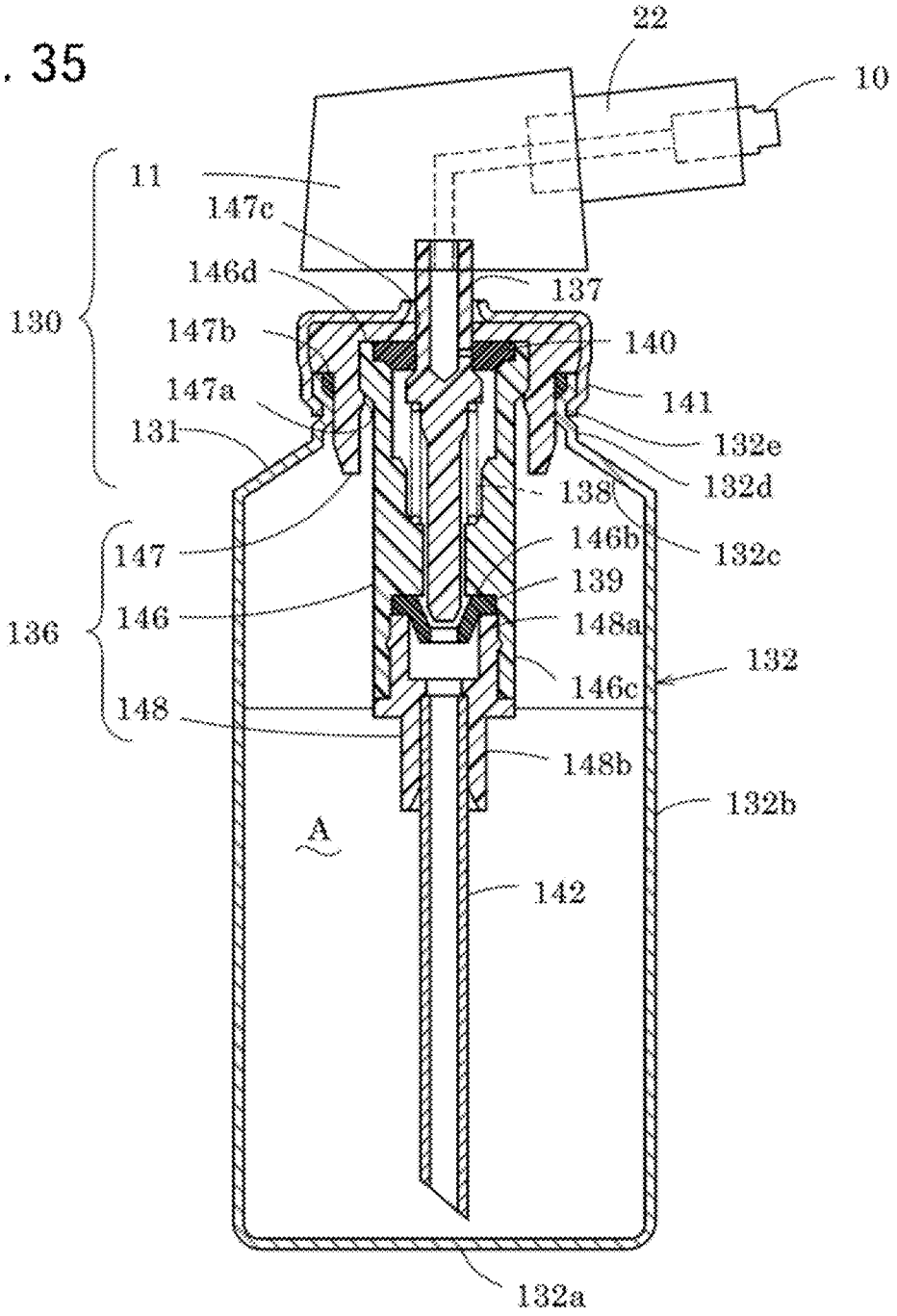
FIG. 35 is a side cross sectional view showing further the other embodiment of the aerosol product of the present invention.

In an aerosol product 130 of FIG. 35, an aerosol container 131 is equipped with a constant amount spray mechanism. The other configuration is substantially same as the aerosol product E of FIG. 1. The aerosol container 131 consists of a pressure-resistant container 132 and a valve 133 attached to the opening of the pressure-resistant container. The pressure-resistant container 132 is equipped with a bottom portion 132*a*, a barrel portion 132*b*, a shoulder portion 132*c*, and a neck portion 132*d* of which the upper end extends cylindrically, and is that in which an annular protrusion 132*e* protruding toward inside is formed in the neck portion.

The valve 133 consists of a housing 136 engagingly stopped by being inserted into the opening of the pressure-resistant container 132, a stem 137 provided so as to be vertically movable within the housing, a spring 138 energizing the stem upward, a ring like seal member 139 engagingly stopped to the lower portion of the housing, a ring like stem rubber 140 engagingly stopped to the upper portion of the housing, a cap 141 for valve which firmly fixes the whole of the valve to the pressure-resistant container 132, and a dip tube 142 attached to the lower end of the housing. In this valve 133, a space constituted by the housing 136 and the seal member 139 serves as a constant amount chamber.

The housing 136 consists of a tubular housing body 146, an upper member 147 closing the upper end thereof, and a lower member 148 closing the lower end thereof. In the housing body 146, a stem rubber engagingly stopping portion 146*a* to engagingly stop the stem rubber 140 is formed in the upper end, a seal member engagingly stopping portion 146*b* to engagingly stop the seal member 139 is formed in the lower end, and a lower member connecting portion 146*c* to connect the lower member 148 is formed in the lower end. The upper member 147 consists of a tubular housing engagingly stopping portion 147*a* to engagingly stop the housing body so as to cover the housing body, and a flange portion 147*b* formed in the upper side face thereof. The housing engagingly stopping portion 147*a* has a raised bottom, a center hole 147*c* is formed in the center thereof to make the stem pass through. The lower member 148 has a body connecting portion 148*a* fitted to the upper end housing body and a dip tube connecting portion 148*b* which connects with the lower end dip tube.

Since being constituted as described above, the stem rubber 140 is engagingly stopped by the housing body 146 and the upper member 147, the seal member 139 is engagingly stopped by the housing body 146 and the lower member 148. The flange portion 147*b* of the upper member 147 of the valve 133 is inserted so as to contact the cylindrical neck portion 132*d* of the pressure-resistant container, by crimping the lower portion of the cap 141 for valve to an annular concave portion 132*e* of the outer periphery of the annular protrusion 132 of the pressure-resistant container, the valve 133 and the pressure-resistant container 132 are firmly fixed. In this embodiment, a seal member is provided between the flange 147*b* and the neck portion 132*d*. However, if it is possible to seal tightly between them, the seal member may be omitted.

In the valve 133, by pushing down the stem 137, the front end of the stem 137 plugs the center hole of the seal member 139. Thereby the connection between the housing 136 and the interior of the pressure-resistant container 132 is shut. Hence after the aerosol composition A within the housing 136 is sprayed, the spray is stopped completely. A different point lies in that, in a usual valve, spray continues while being pushed (for example, the valve 32 of FIG. 1). Hence, it is preferable for performing an accurate constant amount spray.

Figure 1:
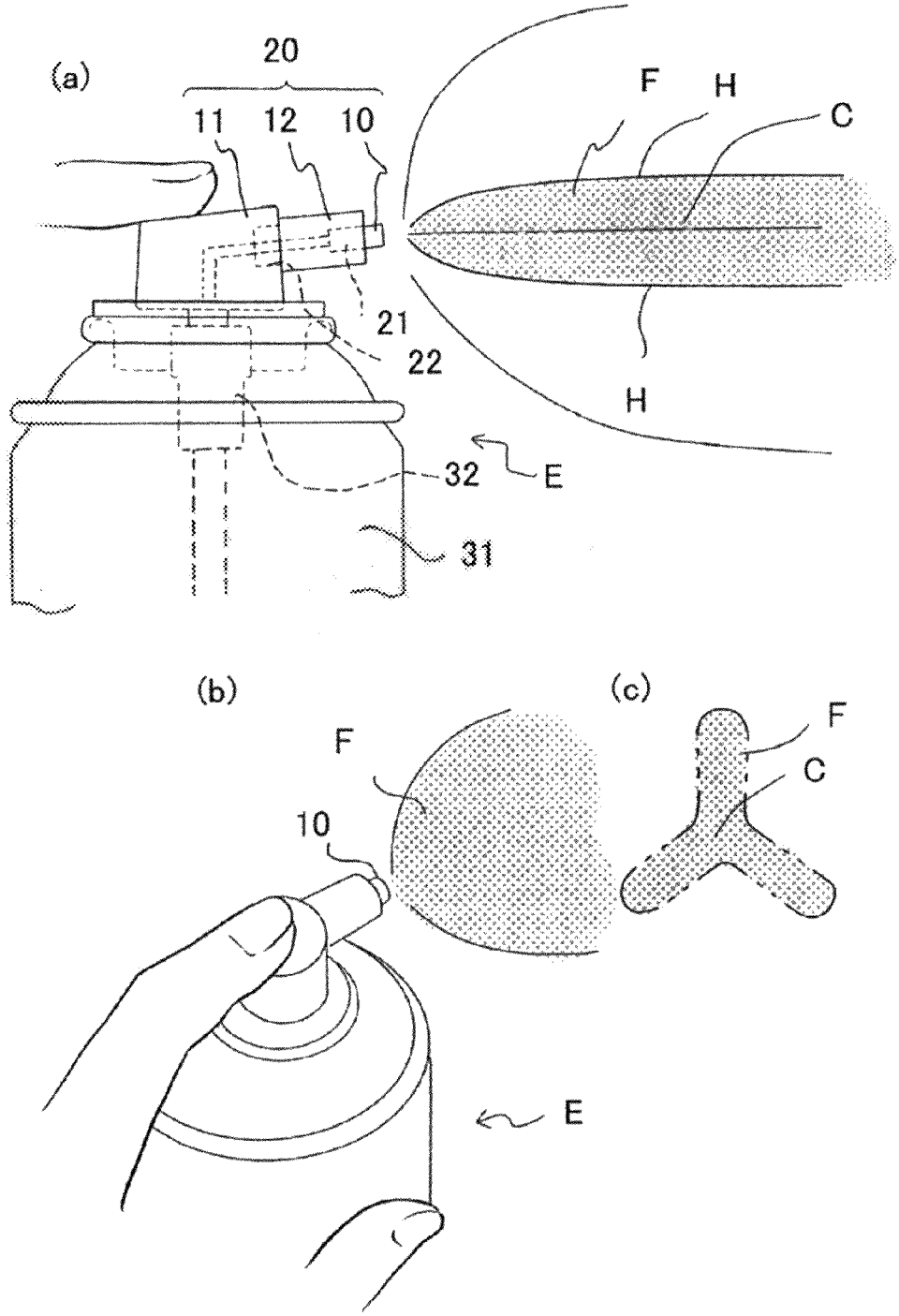
FIG. 1*a* and FIG. 1*b* are respectively a side view and a perspective view showing one embodiment of the aerosol product of the present invention together with a spray pattern thereof.
FIG. 1*c* is a cross sectional view of the spray pattern.

Since this aerosol product 130 is also equipped with the operation member (spray member) 20 same as the aerosol product E of FIG. 1, even if only a constant amount of spray is performed, since it is sprayed efficiently, at least broadly in one direction, a user can view or securely perceive the sprayed object thereof.

EMBODIMENT

Figure 8:
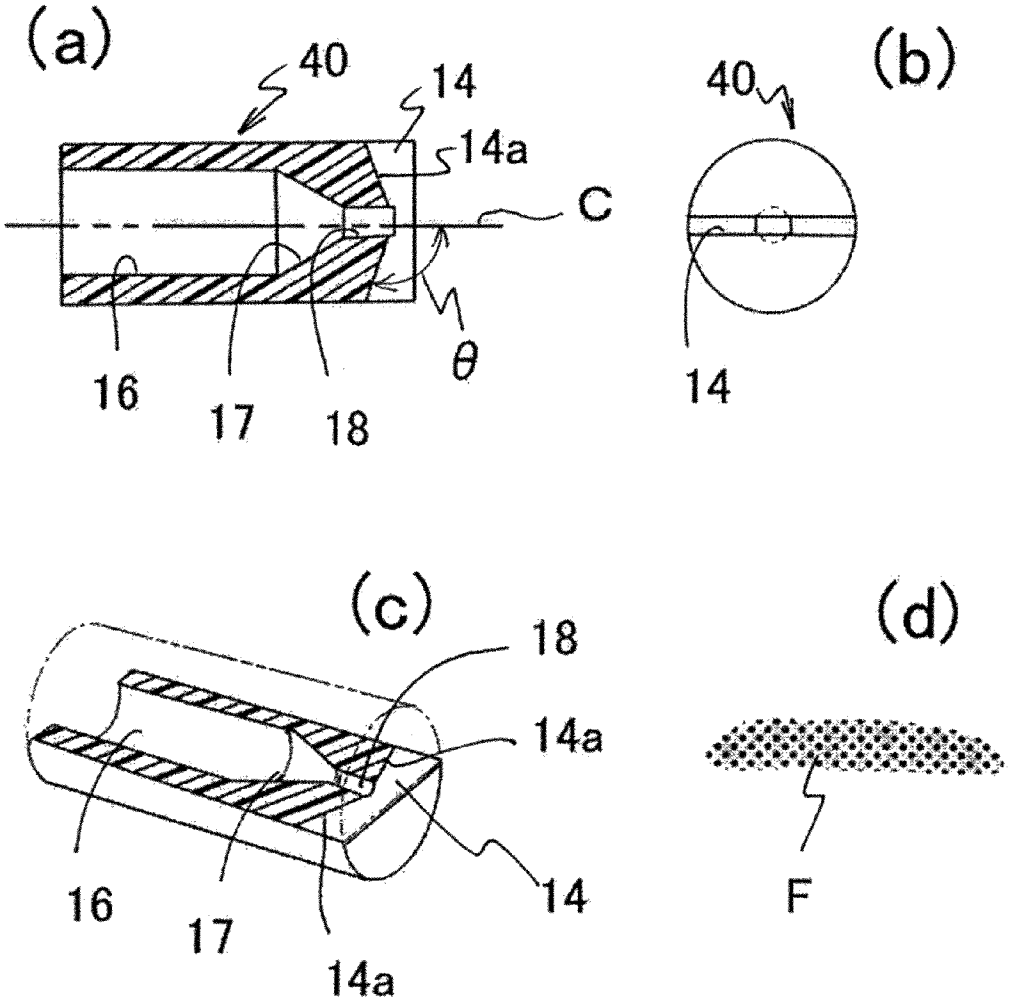
FIG. 8*a* and FIG. 8*b* are respectively a longitudinal cross sectional view and a front elevational view of the other embodiment of the spray nozzle of the present invention.
FIG. 8*c* is a cross sectional view of the spray pattern obtained by the spray nozzle thereof.
Figure 36:
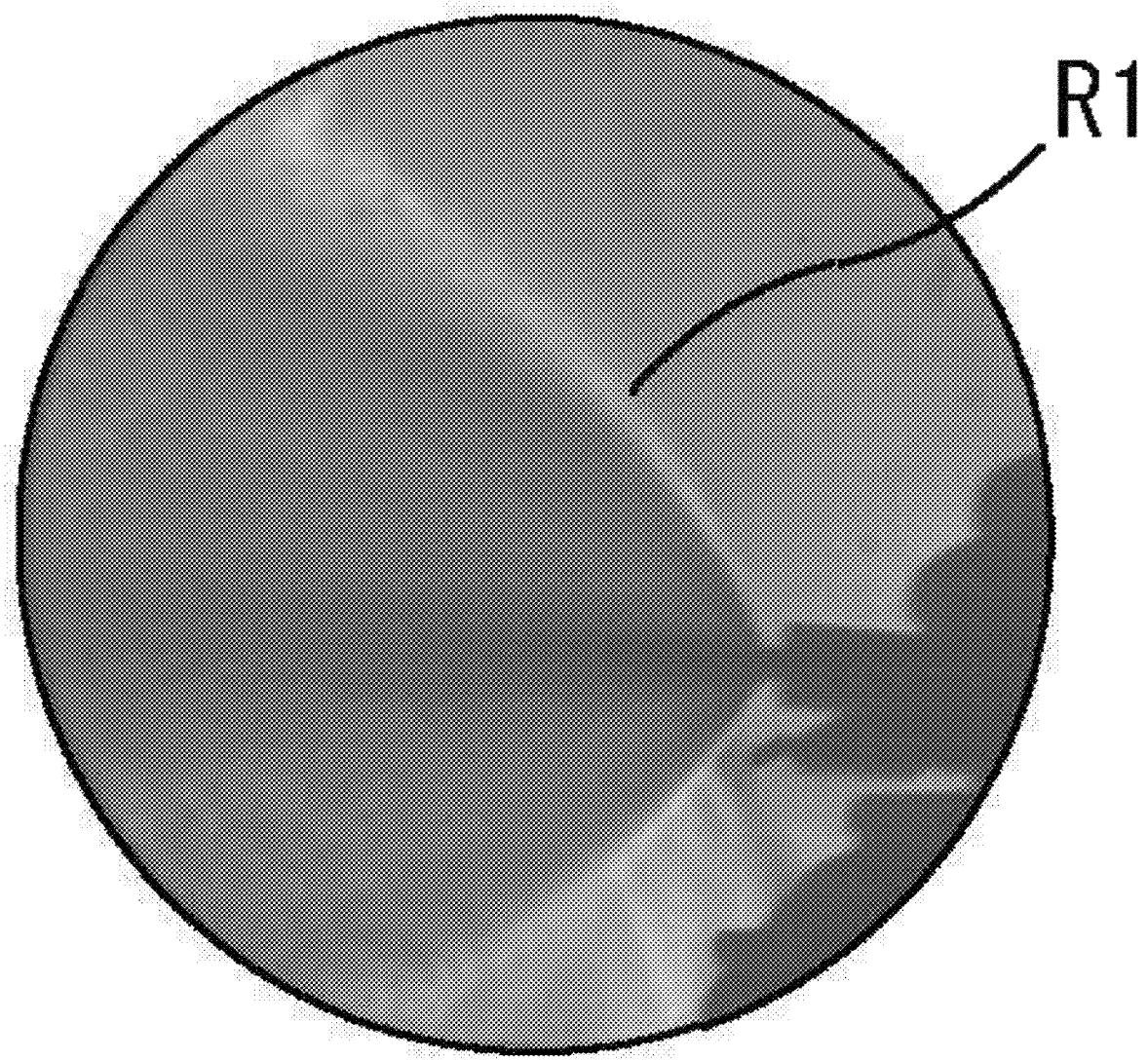
FIG. 36 is a schlieren photography showing the spraying condition of the nozzle of a comparative example.
Figure 37:
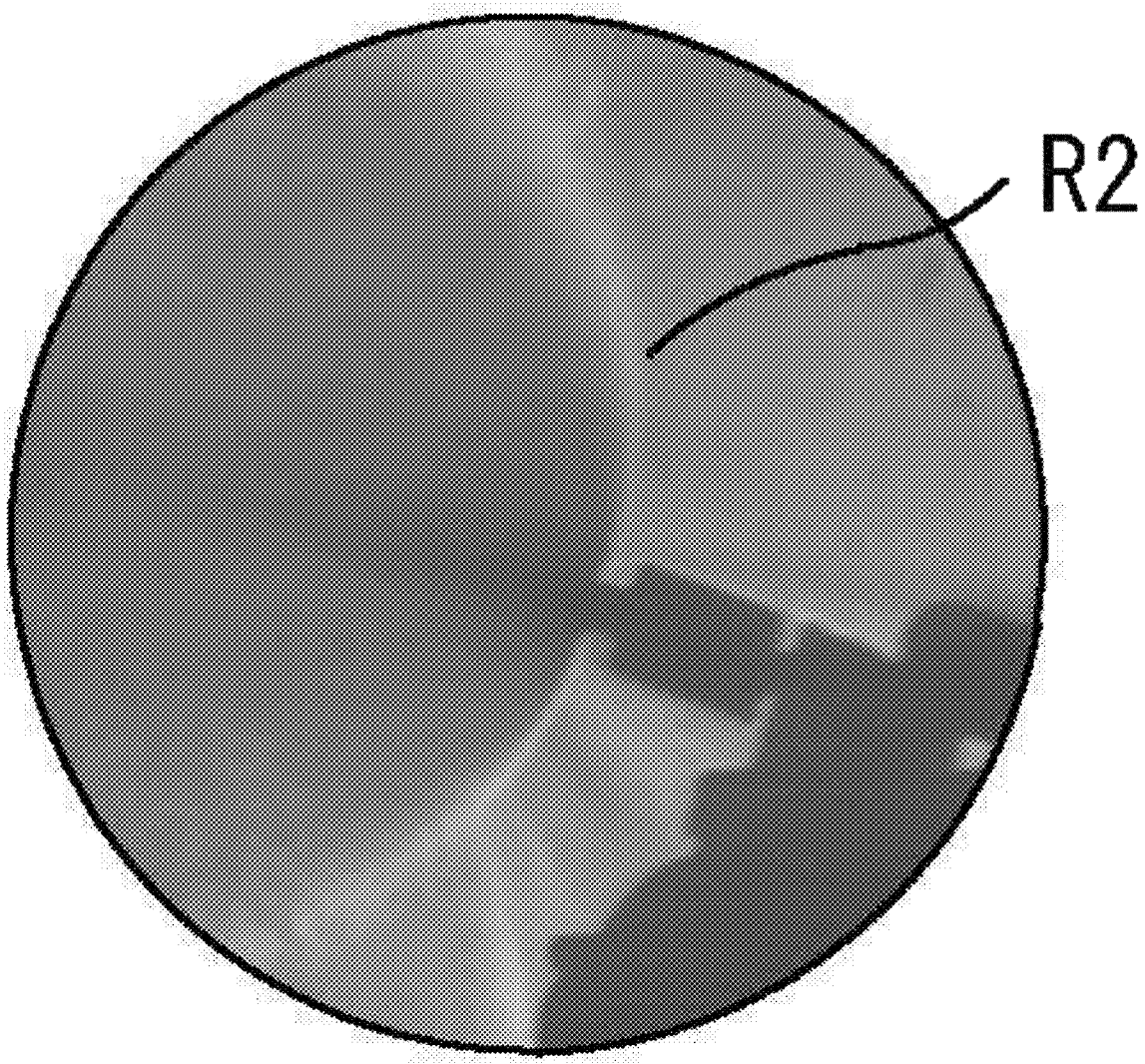
FIG. 37 is a schlieren photography showing the spraying condition of the nozzle of the embodiment.

Next, the effect of the spray nozzle of the present invention is described citing an embodiment and a comparative example. FIG. 36 is a schlieren photograph showing a spray pattern sprayed by a conventional nozzle (FIG. 3 of Patent Document 1), FIG. 37 is a schlieren photograph sprayed by the nozzle 40 of FIG. 8. In addition, the diameter of the spray passage of the nozzle 40 of FIG. 8 is 0.85 mm, the width of the slit passage is 0.45 mm, the depth is 0.6 mm. The both nozzles are attached to an identical container, and the schlieren photograph is photographed. The results are shown in FIG. 36, FIG. 37. As found by comparing FIG. 36 and FIG. 37, in the spray pattern of the comparative example, the component spraying forward is strong, the parabola of the shape is comparatively sharp. In other words, expansion to the periphery is small. On the other hand, in the spray pattern of the nozzle of the embodiment, the component to expand in the circumferential direction is strong, the parabola of the shape is moderate.

What is claimed is:

1. A spray nozzle of which a contour portion of a spray pattern is pulled inside by spraying, a shape along a spray direction of the spray pattern being formed into an approximately semi parabolic shape, wherein the spray nozzle comprises, inside thereof, a passage to make a content pass through, and a convergent taper portion or a gradient portion concentrically provided in a front end of the passage, wherein a center of a front end of the inside of the spray nozzle is plugged, wherein the spray nozzle has a plurality of openings arranged radially relative to a center line of the inside of the spray nozzle, wherein a plurality of slit passages which connect each opening and an outer space are provided respectively, and each slit passage extends from one of the openings in a radial direction relative to the center line of the inside of the spray nozzle such that the slit passages connect to the outer space at different locations from each other, wherein the slit passages are grooves that are formed in an outer face of the spray nozzle and are open to the outer space, wherein the slit passages are independent of one another such that there are no junctions between any of the slit passages, and wherein the slit passages are arranged at equal intervals all the way around the center line of the inside of the spray nozzle.

2. A spray nozzle according to claim 1, wherein the spray pattern is planar or plate-like surrounded by the approximately semi parabolic shape and the center line of the inside of the spray nozzle.

3. A spray nozzle according to claim 1, wherein the spray pattern is composed of more than two line segments expanding outwardly from the center line of the inside of the spray nozzle when viewed from a front.

4. A spray nozzle according to claim 3, wherein the line segments are arranged in rotation symmetry centered at the center line.

5. A spray nozzle according to claim 3, wherein the line segment is an approximately circular are shape.

6. A spray nozzle according to claim 3, wherein the line segments are straight lines or curved lines arranged in a V-character shape.

7. A spray nozzle according to claim 4, wherein the line segments are straight lines or curved lines arranged in a Y-character shape.

8. A spray nozzle according to claim 1, wherein a nozzle center is decentered from the center line of the inside of the spray nozzle, and the line segments of the spray pattern extend toward the approximately opposite side of the nozzle from the center line of the inside of the spray nozzle.

9. A spray nozzle according to claim 1, wherein the spray nozzle is equipped with two or more of nozzle holes, and the spray pattern is composed of line segments of straight lines or curved lines passing through the front end opening of each nozzle hole.

10. A spray nozzle according to claim 1, wherein a small diameter nozzle hole passage concentrically extending from a front end of the taper portion or the gradient portion is provided, a center of a front of the small diameter nozzle hole passage is plugged, and a the plurality of openings which are arranged radially relative to the center line of the inside of the spray nozzle extend from the small diameter nozzle hole passage.

11. A spray nozzle having, inside thereof, a passage to make a content pass through, a convergent taper portion or a gradient portion concentrically provided in a front end of the passage, and a small diameter nozzle hole passage concentrically extending from a front end of the taper portion or the gradient portion, wherein a center of a front end of the small diameter nozzle hole passage of the spray nozzle is plugged relative to a center line of the inside of the spray nozzle, wherein the spray nozzle has a plurality of openings arranged radially relative to a center line of the inside of the spray nozzle, and wherein a plurality of slit passages which connect the openings and an outer space are provided, and each slit passage extends from one of the openings in a radial direction relative to the center line of the inside of the spray nozzle such that the slit passages connect to the outer space at different locations from each other, wherein the slit passages are grooves that are formed in an outer face of the spray nozzle and are open to the outer space, wherein the slit passages are independent of one another such that there are no junctions between any of the slit passages, and wherein the slit passages are arranged at equal intervals all the way around the center line of the inside of the spray nozzle.

12. A spray nozzle having, inside thereof, a passage to make a content pass through, and a convergent taper portion or a gradient portion concentrically provided in a front end of the passage, wherein a center of a front end of the taper portion or the gradient portion of the spray nozzle is plugged, wherein the spray nozzle has a plurality of openings arranged radially relative to a center line of the inside of the spray nozzle, and wherein a plurality of slit passages which connect the openings and an outer space are provided, and each slit passage extends from one of the openings in a radial direction relative to the center line of the inside of the spray nozzle such that the slit passages connect to the outer space at different locations from each other, wherein the slit passages are grooves that are formed in an outer face of the spray nozzle and are open to the outer space, wherein the slit passages are independent of one another such that there are no junctions between any of the slit passages, and wherein the slit passages are arranged at equal intervals all the way around the center line of the inside of the spray nozzle.

13. A spray nozzle according to claim 1, wherein the spray pattern is of parallel two planes when immediately after spraying, and then both sides are integrated into one plane by coming close.

14. An aerosol product equipped with a container body, a valve provided on the upper end of the container body, and a spray nozzle according to any one of claims 1, 11, and 12 attached to the valve.

15. An aerosol product according to claim 14, wherein the valve is a constant amount spray valve.

16. A spray nozzle according to claim 1 or 12, wherein a center of a front end of the taper portion or the gradient portion is plugged, and the plurality of openings which are arranged radially relative to the center line of the inside of the spray nozzle extend from the tapered portion or the gradient portion.

17. A spray nozzle according to any one of claims 1, 10, 11, and 12, wherein each of the plurality of openings faces both an approximately radial direction and a front side from an outer peripheral of the plug, and wherein each slit passage extends from the approximately radial direction facing portion of the corresponding opening in the approximately radial direction and from the front side facing portion of the corresponding opening in an axial direction that is parallel to the center line of the inside of the spray nozzle.

18. A spray nozzle according to any one of claims 1, 10, 11, and 12, wherein a cylindrical small diameter portion is concentrically provided in a front end of outside, a back side of the cylindrical small diameter portion is formed to be a step portion, the slit passage is formed on a front end of the cylindrical small diameter portion, and a pair of passage wall is provided from an outer periphery of the cylindrical small diameter portion to the step portion.

* * * * *